United States Patent [19]

Cripe

[11] Patent Number: 4,955,292

[45] Date of Patent: Sep. 11, 1990

[54] DUAL-MODE RAIL-HIGHWAY SEMI-TRAILER WITH SEPARABLE BOGIE

[75] Inventor: Christopher A. Cripe, Coatesville, Pa.

[73] Assignee: The Chamberlain Group, Inc., Elmhurst, Ill.

[21] Appl. No.: 553,042

[22] Filed: Nov. 18, 1983

[51] Int. Cl.[5] ..... B61F 3/12; B61F 5/16; B61G 1/28

[52] U.S. Cl. ..... 105/4.2; 105/4.3; 105/199.4; 105/215.2; 213/182

[58] Field of Search ..... 105/3, 215 C, 4 R, 4 A, 105/4.1–4.3, 8.1, 199.4, 215.2, 72.2; 213/182, 188

[56] References Cited

U.S. PATENT DOCUMENTS

| | | | |
|---|---|---|---|
| 1,681,659 | 8/1928 | Clark et al. | 105/4.1 |
| 1,851,702 | 3/1932 | Griffin | 105/4.1 |
| 2,019,288 | 10/1935 | Beckette | 105/4.1 |
| 2,036,535 | 4/1936 | Nelson | 105/3 |
| 2,170,090 | 8/1939 | Ronk | 104/4 A |
| 2,963,986 | 12/1960 | Dobson | 105/4.1 X |
| 3,476,040 | 11/1969 | Karakashian et al. | 105/4.1 |
| 3,646,604 | 2/1972 | Tack et al. | 105/4.3 |
| 3,716,146 | 2/1973 | Altherr | 105/4.3 X |
| 4,202,454 | 5/1980 | Browne et al. | 105/3 X |
| 4,364,315 | 12/1982 | Beatty | 105/215 C |
| 4,381,713 | 5/1983 | Cripe | 105/215 C |
| 4,416,571 | 11/1983 | Krause | 105/215 c X |
| 4,448,132 | 5/1984 | Beatty | 105/215 C |
| 4,452,147 | 6/1984 | Jlouc | 105/4 R X |

FOREIGN PATENT DOCUMENTS 0143614 6/1985 European Pat. Off. .

OTHER PUBLICATIONS

Riefler, Monte P. and Wicks, Harry O., "Railmaster–A New Development in Transportation", ITE Upstate Section Newsletter, vol. XIV, No. 2, Feb. 1983, pp. 3–4.

*Primary Examiner*—Margaret A. Focarino
*Assistant Examiner*—Joseph D. Pape
*Attorney, Agent, or Firm*—Neuman, Williams, Anderson & Olson

[57] ABSTRACT

A dual-mode semi-trailer having over-the-road or highway running gear with rubber tired wheels in which a demountable flanged rail wheel bogie is employed, the body being supported upon said highway running gear during over-the-road travel by air-springs and being supported upon said rail wheel bogie during travel over railroad tracks, a mechanism being provided to selectively raise and lower said highway running gear for selective use in the railroad mode or highway mode of travel, another mechanism also being provided to attach or detach said rail wheel bogie from said body for operation in the rail or highway mode of travel, the semi-trailers bodies being coupleable end-to-end to form a train of multiple semi-trailers in the railroad mode of travel. The highway running gear may be of the single axle or tandem axle type, in each case each axle carrying sets of tires of conventional size allowing loads as high as legally permitted to be carried over the road in the highway mode of travel, the highway running gear being slidably mounted to the vehicle body allowing adjustable fore-aft positioning to further enhance permissable highway load capacity due to improved weight distribution, the rail wheel bogie being preferably of the dual-axle type.

22 Claims, 11 Drawing Sheets

DUAL-MODE RAIL-HIGHWAY SEMI-TRAILER WITH SEPARABLE BOGIE

This invention relates to dual-mode rail-highway semi-trailer vehicles, capable of operation over highways on rubber tired wheels and over railroad tracks on sets of flanged rail wheels. Two basic approaches to vehicles have evolved; the first type employing some form of detachable railroad bogie so that each vehicle itself is permanently equipped with only highway wheels, and the second type, in which each vehicle carries both highway and railroad wheels at all times, with means being provided to alternately raise and lower each type of wheel set according to the desired mode of travel.

In the first aforementioned basic approach, the railroad bogie functioned as the bridge between trailer bodies during railroad operation, the rear end of the leading trailer and the nose end of the following trailer each being vertically supported on opposing ends of an intermediate railroad bogie as disclosed in the U.S. Pat. No. 2,036,535, of Nelson U.S. Pat. No. 2,709,969, Andert and U.S. Pat. No. 3,342,141 Madden. This approach causes severe problems in dealing with the large buff (compression) and draft (tension) forces generated in train configuration, which must then be transmitted from each trailer body, through the intermediate railroad bogie, then into the next trailer body, and so on. Heavy, complex mechanical couplings are therefore required at each body-bogie juncture, and heavy body reinforcement is required at these connecting points. In addition, dynamic stability of the railroad bogie suffers as undesired yaw forces could be generated at the railroad bogie under buff and draft conditions on curves. Further, railroad bogie stability problems could exist when a heavily-laden trailer is coupled adjacent to an empty unit, thus inducing an undesired pitching moment into the intermediate bogie. Still another drawback to such schemes is the requirement of special, complex railroad bogies and complex multiple coupling and locking mechanisms to affect the connections between trailer bodies via the bogies. Also a simple but practical means of making the transition from highway mode of operation to rail mode of operation is lacking.

In the second aforementioned basic approach, varying means are employed of selectively raising and lowering the highway and rail wheel sets to operatively position the desired wheel set while inoperatively positioning the other wheel set, such as disclosed in the patents of Browne U.S. Pat. No. 2,889,785, and U.S. Pat. No. 3,342,141, Browne et al U.S. Pat. No. 4,202,277, and Wanner U.S. Pat. No. 3,002,469. This approach involves relative mechanical complexity regardless of the actual means employed in the raising and lowering processes. Further, special railroad suspension means are required which must be compatible with the raising and lowering methods employed. In addition, because the heavy railroad bogies are carried at all times with the vehicles during highway operations, pay-load-carrying capacity may be limited as compared to conventional over-the-road semi-trailers. Also, since such vehicles usually employ a single-axle railroad bogie, but a dual-axle railroad bogie is preferable to the railroad industry, the extra weight of a dual-axle railroad bogie could be unacceptable during highway operation. Additionally, maintenance of such vehicles may create some difficulties because both highway and rail suspension systems and their respective raising and lowering devices occupy the same general area near the rear of the vehicle body.

It is the primary object of this invention to provide a dual-mode rail-highway vehicle which overcomes the aforementioned disadvantages of the prior art vehicles and is therefore more economical and more practical in both construction and operation.

Another object of the invention is to provide a dual-mode rail-highway vehicle with improved payload-carrying capacity in both highway and rail modes of operation.

Another object of the invention is to provide a dual-mode rail-highway vehicle which utilizes a dual-axle railroad bogie or truck.

Another object of the invention is to provide a dual-mode rail-highway vehicle of the character described employing simple and practical means to releasably lock the railroad bogie to the vehicle body.

Another object of the invention is to provide a dual-mode rail-highway vehicle of the character described employing simple and practical means of transferring from the rail mode to the highway mode of operation or vice-versa.

Another object of the invention is to provide a dual-mode rail-highway vehicle system of the character described in which large-scale operation can be effected with fewer railroad bogies than vehicle bodies since, at any given time, not all of the vehicle bodies would be coupled to railroad bogies for operation in the railroad mode of travel.

Another object of the invention is to provide a dual-mode rail-highway vehicle of the character described employing a slidably mounted highway running gear, said highway running gear capable of being positioned near the extreme rear of the vehicle body in the absence of the detachable railroad bogie, thus providing the capability of improving the vehicle weight distribution and enhancing the vehicle payload capacity while in the highway mode of operation.

Another object of the invention is to provide a dual-mode rail-highway vehicle in which buff and draft forces in train operation are carried directly between the vehicle bodies rather than through the detachable railroad bogies, thus preventing undesired yaw and pitch forces from being transmitted to said railroad bogies, and eliminating heavy and complex multiple coupling devices between vehicle bodies and railroad bogies.

The foregoing objects are attained by structure which comprises a vehicle body in the form of a semi-trailer of conventional length, width and height, a tandem axle, rubber tired highway suspension slidably mounted to the underframe of the vehicle body employing conventional semi-trailer air springs, a rear underframe structure integral with the vehicle body, arranged to accept a suitably-equipped railroad bogie and equipped with means to positively lock into or release from said railroad bogie, means to couple the vehicle bodies end-to-end to form a train for rail operation and uncouple them for highway operation, means to selectively inflate or deflate the highway running gear air-springs so that the highway axle and wheel assemblies may be raised and stored in an elevated inoperative position while operating in the rail mode or extended to engage the ground for high-way operation, the foregoing components being so constructed and arranged as to render them easily adaptable to various vehicle body styles, such as van, tank, hopper, etc., and a suitably equipped dual-axle railroad bogie including adapting means to mate with the vehicle body rear underframe structure, said railroad bogie also being equipped with suitable rail brake rigging, brake cylinder, and hand-brake means.

These and other objects of the invention will become more apparent as the following description proceeds in conjunction with the accompanying drawings, wherein.

Figure 1A:
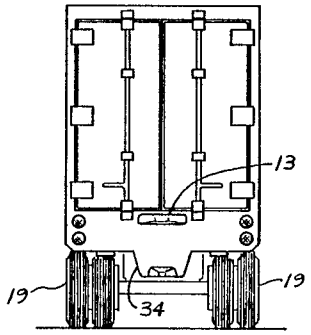
FIG. 1A is a rear elevational view of the vehicle in the highway mode.
Figure 1:
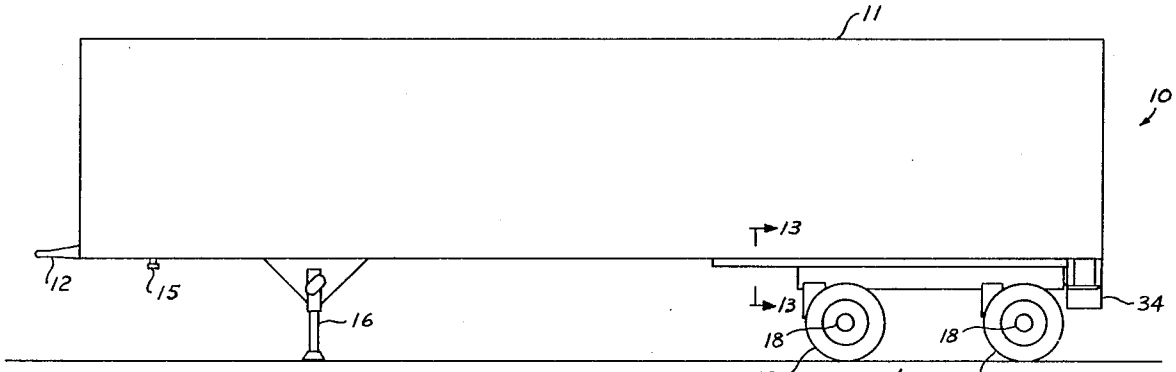
FIG. 1 is a diagrammatic side elevational view of the vehicle shown ready to be coupled to a tractor for the highway mode of operation.
Figure 2:
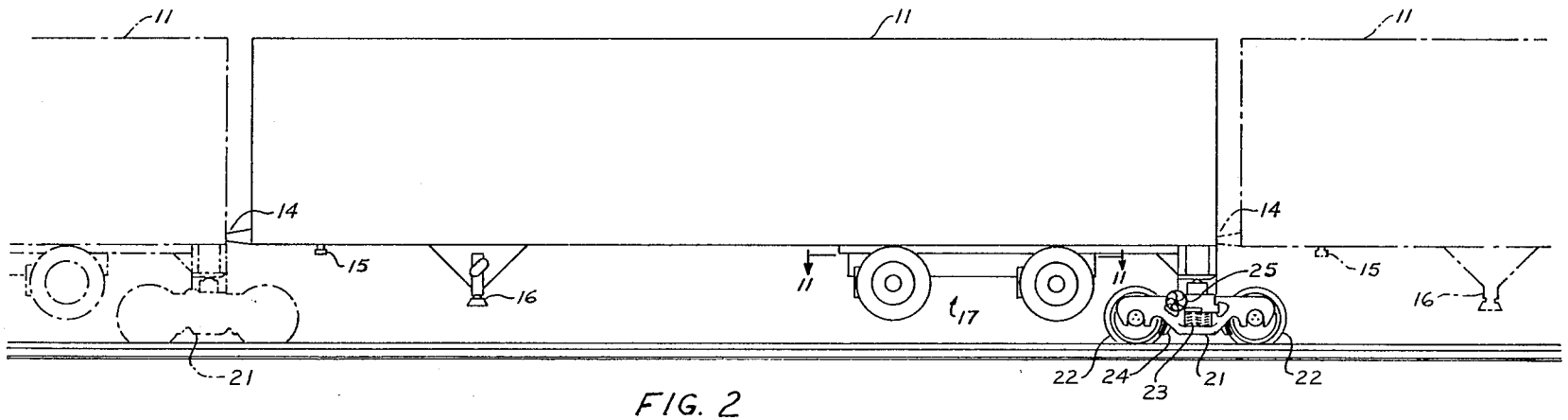
FIG. 2 is a view similar to FIG. 1 of the vehicle in the railroad mode of operation with the vehicles coupled end-to-end to form a train.

Referring first to FIGS. 1, 1A and 2, the present vehicle is generally shown at 10 and includes a body 11 of conventional semi-trailer diamensions which could be 48 ft. long, having a male coupling member 12 at its front end, and a female member 13 at its rear end to receive the male coupler of an adjacent body as shown at 14 in FIG. 2 to form a train for the railroad mode of operation. The vehicle also includes a conventional kingpin 15 adjacent its front end for removable coupling to the fifth wheel of a tractor for the highway mode of operation, conventionally placed telescoping semi-trailer landing gear 16, highway running gear 17 including tandem axles 18 (although a single axle suspension could also be used),each axle mounting rubber-tired wheels 19, the running gear being slidably mounted to the underframe of the body towards the rear thereof, and employing air spring suspension means, a rear underframe structure 34 integral with the trailer body arranged to support the trailer body upon the railroad bogie during operation in the rail mode, and a detachable dual axle railroad bogie 21, which includes axles mounting flanged railroad wheels 22 at appropriate rail spacing transversely, the bogie including integral suspension means 23, braking mechanism 24, and hand-brake means 25, as shown in FIG. 2. The arrangement is such that by appropriate operation of pneumatic means, the air springs suspending the highway wheels may be inflated to lower the highway wheels 19 into engagement with the ground, said highway running gear supporting the vehicle during the highway mode of operation as shown in FIG. 1. It will be understood that in the highway mode of operation, the landing gear 16 is in the load supporting position during which time a conventional tractor is coupled to kingpin 15, the landing gear is then telescoped to a raised position and the vehicle will then be driven as an over-the-road tractor-semi-trailer combination.

Railroad operation is attained by backing the vehicle (the vehicle being in the highway mode of operation just described), adjacent to and in proper alignment with a railroad bogie which is in proper engagement with the railroad tracks. The arrangement is such that by appropriate operation of pneumatic means, the air springs suspending the highway wheels may be temporarily over-inflated, thus raising the vehicle body slightly above normal ride height, the vehicle then being backed onto and into engagement with the railroad bogie. Further operation of said pneumatic means is then used to exhaust the air springs suspending the highway wheels, said wheels subsequently being retracted into their stored, raised, inoperative position as shown in FIG. 2, the weight of the vehicle body then being supported by the railroad bogie.

Releasable locking means are then operated to positively lock and secure the railroad bogie to the vehicle body, and in this latter railroad mode, the vehicle may be coupled as at 14 end-to-end with similar vehicles to form a train to be pulled by a suitable locomotive.

Transfer of the vehicle from the railroad mode to the highway mode of operation is the reverse of the process just described, a highway tractor is coupled to kingpin 15, and the railroad bogie is unlocked from the vehicle body. Pneumatic means are operated to temporarily over-inflate the air springs suspending the highway wheels, the highway wheels thus lowering into engagement with the ground and raising the vehicle body slightly above normal ride height, thereby disengaging the vehicle from the railroad bogie. The vehicle may then be pulled forward and driven as a tractor-semi-trailer combination.

The sliding capability of the highway running gear may be seen in FIGS. 1 and 2, the former illustrates the vehicle in the highway mode of operation with the highway running gear 17 shown in its rearmost position, and the latter illustrating the vehicle in the railroad mode of operation with the highway running gear in its forwardmost position, it being understood that utilizing the rearmost position substantially increases the legal highway pay load capacity of the vehicle by creating a more favorable front-rear trailer weight distribution and longer distance between the tractor tandem and trailer tandem axles, thus allowing higher loads to be carried under nationally recognized highway bridge formula load limitation laws. The highway running gear could be left in its forwardmost position under lighter highway payload conditions. The highway running gear includes locking means that enable said running gear to be locked securely in either of the positions indicated. Changing the position of the railroad running gear is done before connecting the vehicle to the railroad bogie when transferring from highway to railroad mode or after disconnecting from the railroad bogie when transferring from the rail mode to the highway mode, by applying the highway brakes on the vehicle, releasing the locking device, and either backing up or pulling forward with a highway tractor, the vehicle body sliding fore or aft over the stationary highway running gear until the desired position is attained, the locking device then being re-arranged at the new running gear position.

Figure 5:
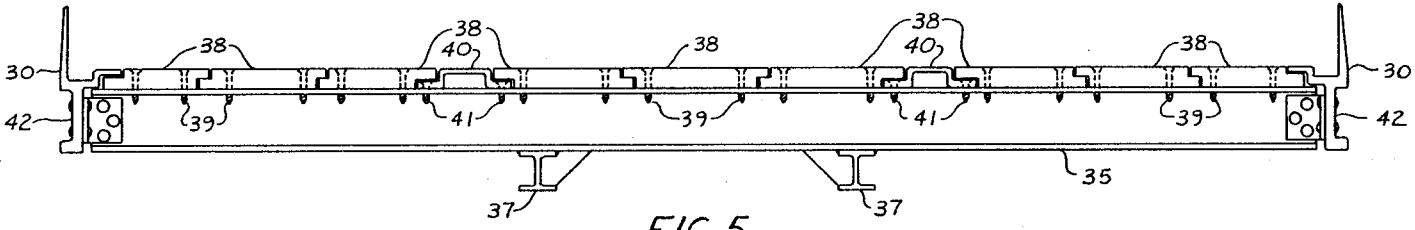
FIG. 5 is an enlarged transverse sectional view of the vehicle floor and underframe construction taken on the line 5—5 of FIG. 3.
Figure 4:
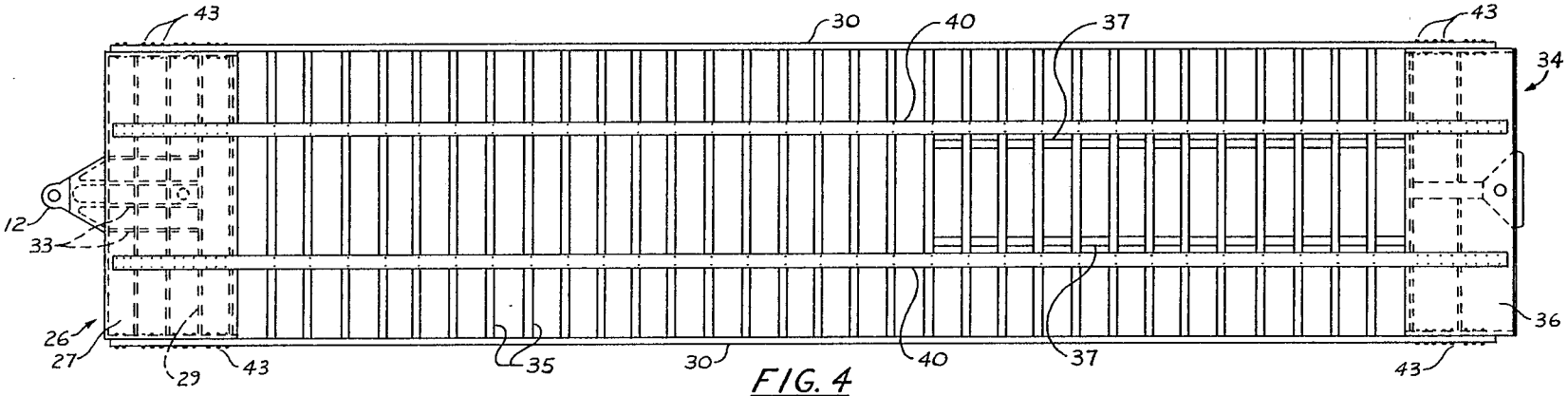
FIG. 4 is a plan view of the vehicle underframe construction shown with the floorboards omitted for clarity.
Figure 3:
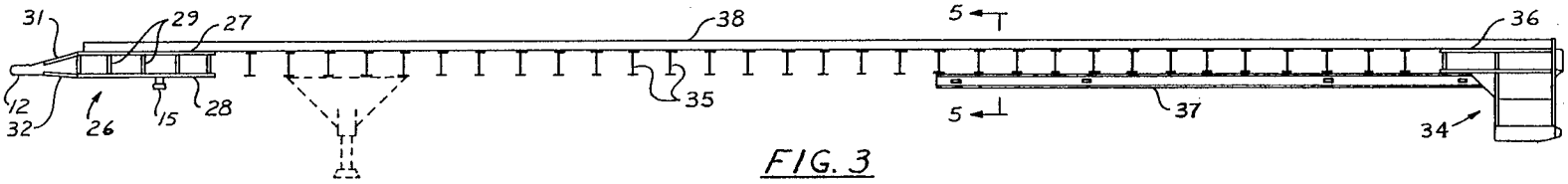
FIG. 3 is a longitudinal sectional view of the vehicle floor and underframe construction.

Coming now to FIGS. 3–5, it will be seen from FIGS. 3 & 4 that the vehicle adjacent its front end is provided with a conventional semi-trailer kingpin subframe 26 which runs the full width of the trailer and is secured between the body side rails 30, and which extends about 54" back into the trailer and in one typical arrangement is composed of upper and lower plates 27 and 28, joined by cross webs 29 forming, in effect, a box beam, the male coupling member 12 for railroad operations being integrally joined to the king-pin subframe structure by upper 31, and lower 32 plates and longitudinal webs 33. At the rear end of the trailer is a rear underframe structure 34 which runs the full width of the trailer and which extends about 30" into the trailer.

Between the rear end of the kingpin subframe 26 and the front end of the rear underframe 34 a number of I-beam crossmembers 35 on about 12" are provided, secured at their ends to the body side rails 30, to some of which are secured the running gear guide beams 37, the upper flanges of the crossmembers 35 being on a level with the upper plate 27 of the kingpin subframe and the upper plate 36 of the rear underframe.

Running lengthwise of the trailer are floor boards 38, about 12" wide, preferably laminated hardwood, which along their abutting edges are milled into ship lap or other suitable joints. The floor boards are secured to the upper plates 27 and 36 of the kingpin subframe and rear underframe structures respectively and are also secured to the upper flanges of the crossmembers 35 by a multitude of self-tapping screws 39. Also running lengthwise of the trailer and transversely spaced on either side of the vehicle longitudinal centerline are hat-section floor rails 40, typically of extruded aluminum construction, which are secured with fasteners to the upper plates 27 and 36 of the kingpin subframe and rear underframe structures respectively and are also secured to the upper flanges of the crossmembers 35 by self-tapping screws 41. Additionally, side rails 30 extend the full length of the trailer from front to rear and are usually an aluminum extrusion of profile shown in FIG. 5 except that in the present vehicle the portion 42 of each side rail beneath the floor is about twice the thickness of conventional side rails. The side faces of the kingpin subframe 26 and rear underframe 34 are secured to said side rails with a plurality of fasteners 43, as shown in FIG. 4.

The structure heretofore described is capable of transmitting buff and draft forces of a high order of magnitude through the vehicle, particularly when the vehicles are coupled and running in the railroad mode as shown in FIG. 2, yet eliminates the need for a heavy center sill structure as is common railroad practice.

Figure 6:
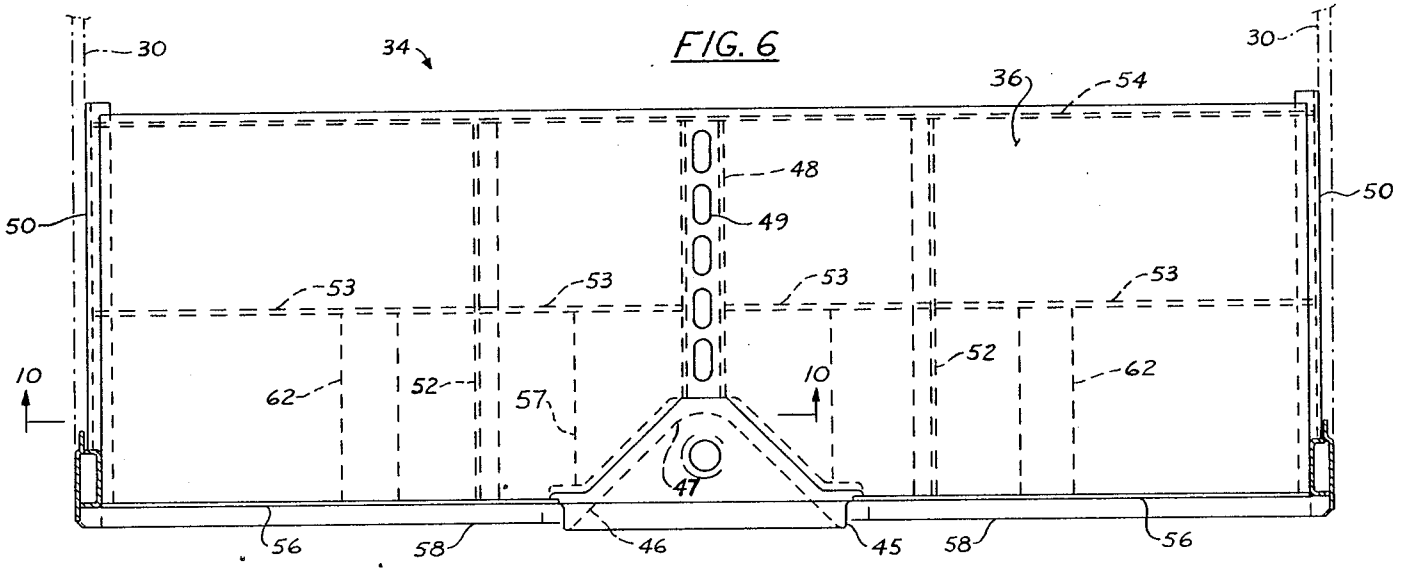
FIG. 6 is a top plan view of the rear underframe construction of the vehicle.
Figure 7:
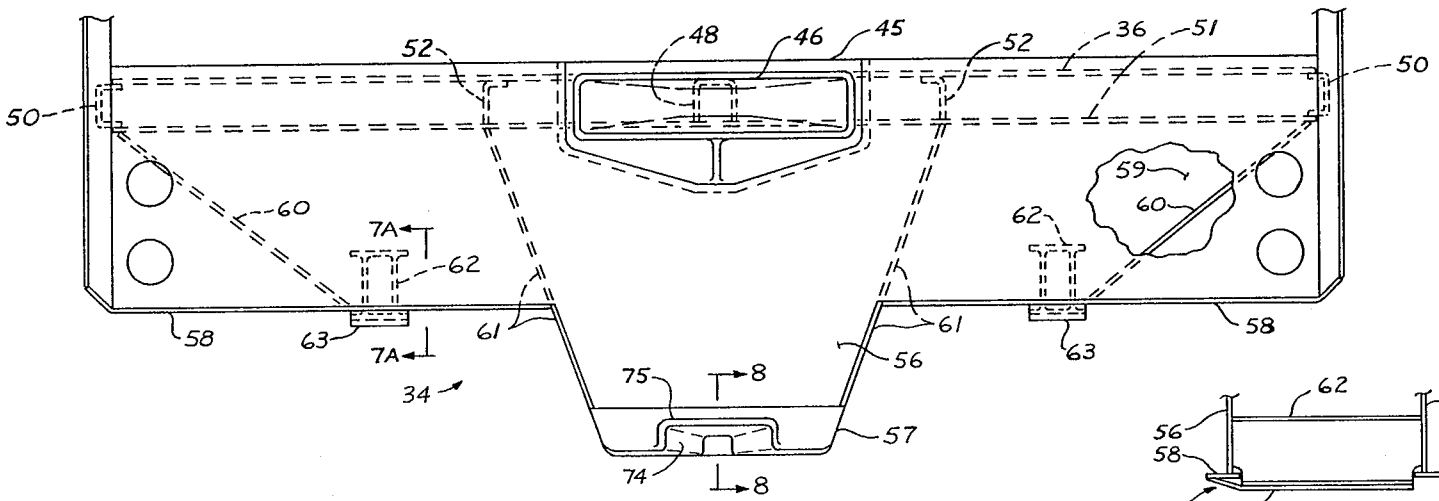
FIG. 7 is a rear elevational view of the rear underframe construction of the vehicle.
Figure 7A:
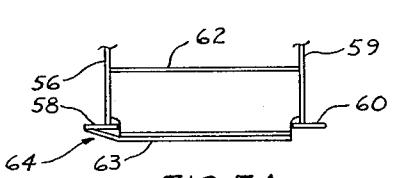
FIG. 7A is a partial longitudinal sectional view of the rear underframe construction of the vehicle taken on the line 7A—7A of FIG. 7.

Referring to FIGS. 6, 7, and 7A, the rear underframe structure 34 includes a central female coupler casting 45 which may include a horizontal slot 46 terminating in an arcuate wall 47 adapted to receive the male coupling member extending from the front of an adjacent vehicle. Details of one such suitable coupling system may be found in Browne et al U.S. Pat. No. 4,202,454 and Hindin et al U.S. Pat. No. 4,311,244.

Extending longitudinally from the casting 45 and secured thereto as by welding is a web member 48 shown here as a channel. The upper or top plate 36 which extends the full width of the vehicle and about 30" into the same is welded to the top of the channel member 48 through openings 49. Extending longitudinally on both sides of the rear underframe structure for fastening to the median postions 42 of the side rails 30 are side channel members 50, the side edges of top plate 36 being welded thereto along the top flanges of said side channels. A bottom plate 51 is provided which is substantially co-existive with the top plate 36 and which is spaced vertically therebeneath, the bottom plate being welded to the bottom of the central channel member 48 and to the bottom flanges of the side channel members 50. Thus the top bottom plates form, in effect, a sandwich between which are welded additional longitudinal and transverse stiffening members 52, 53, and 54.

At its rear, the rear underframe structure includes a vertically depending plate 56 of generally "T" shape when viewed from the rear which is welded to the central female coupler casting 45 and to the rear edges of the top and bottom plates, the central lower portion of which is welded to a special "receiver" casting 57. The plate 56 is welded along its lower outside edges to bottom flanges 58 which extend to the full width of the vehicle on each side.

At approximately its longitudinal center, the rear underframe structure includes a second vertically depending plate 59, of generally the same type as just described, the upper edge of which is in alignment with transverse stiffeners 53 located between the aforementioned top and bottom plates of the structure. The upper edge of this plate 59 is welded to the bottom plate 51, the central lower portion being welded to the special receiver casting 57, flanges 60 being welded along its lower outside edges to the full width of the vehicle on each side.

Between the aforementioned vertically depending plates 56 and 59 are welded a pair of longitudinal plate members 61 equally disposed on each side of the vehicle longitudinal centerline, the upper edges of which are welded to the bottom plate 51 of the rear underframe structure in alignment with longitudinal sitffeners 52 located between the top and bottom plates, the lower edges being welded to the special receiver casting, thus forming a robust box beam supporting the receiver casting, this structure being capable of supporting the vehicle body upon the railroad bogie bolster.

Also between the aforementioned vertically depending plates 56 and 59 are welded longitudinally oriented beam members 62 at appropriate spacing transversely on each side of the vehicle longitudinal centerline to substantially equal the railroad bogie bolster side bearing spacing, the beam members having replaceable wear plates 63 secured to their lower surfaces. As can be seen from examining FIG. 7A, these beam members are provided with an upward taper or lead toward the rear of the vehicle forming, in effect, small ramps 64 to assist in hook-up to a railroad bogie as will be seen later.

Figure 8:
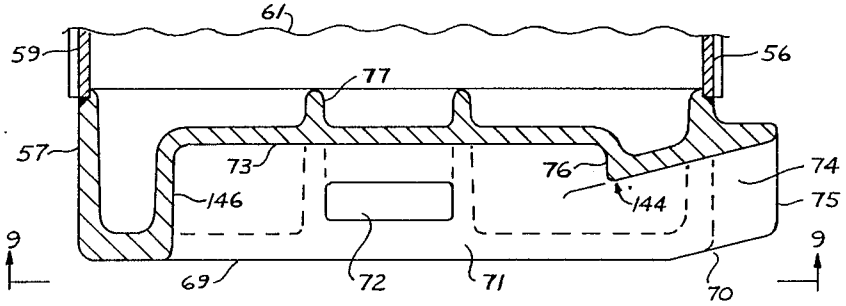
FIG. 8 is a longitudinal sectional view of the receiver casting of the vehicle rear underframe, taken on the line 8—8 of FIG. 7.
Figure 9:
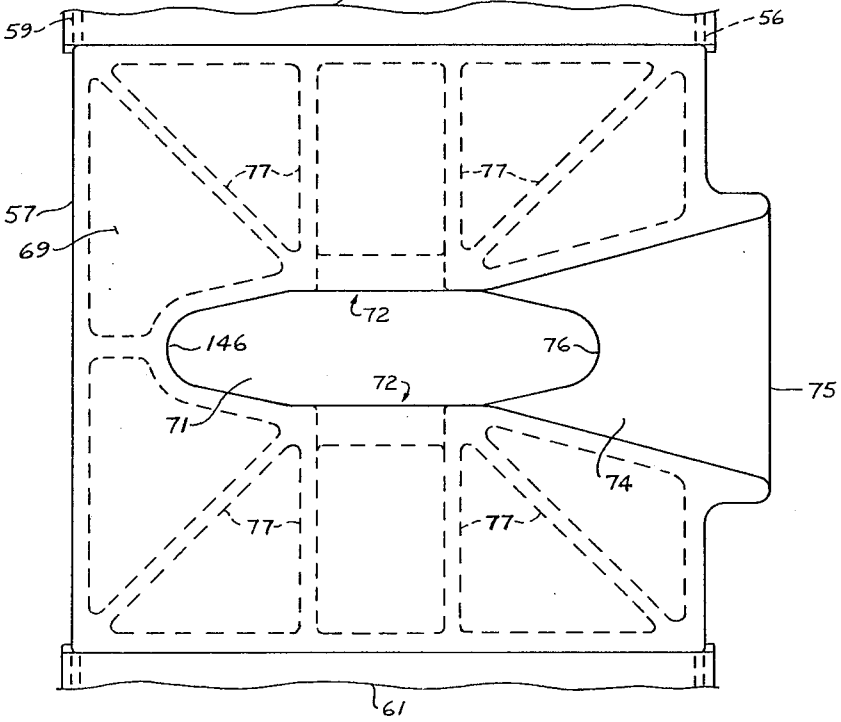
FIG. 9 is a bottom view of the receiver casting of the vehicle rear underframe, as seen from line 9—9 of FIG. 8.

The receiver casting 57 is shown in detail in FIGS. 8 and 9. The bottom surface 69 is substantially flat with an upward taper or lead 70 provided toward the rear of the vehicle to serve as a ramp during hook-up to a railroad bogie. Inset into the bottom surface is a pocket region 71, generally oblong in plan view, whose shape substantially matches that of the rail bogie center plate adapter lug which will be discussed later. Two holes 72, which may be of rectangular form, lead into the pocket region, one on each side of the longitudinal centerline, the holes being placed approximately midway between the bottom surface 69 of the receiver casting and the upper sufface of roof 73 of the pocket region at its longitudinal center. These holes accommodate the railroad bogie locking device. Leading into the pocket region is a tapered throat 74 extending toward the rear of the vehicle and terminating in a rectangular mouth 75 at the vehicle's extreme rear (see also FIG. 7), the mouth and throat areas being inset into the bottom surface of the receiver. As can be seen in FIGS. 8 and 9, the throat tapers in plan view, progressively widening from the pocket region toward the mouth, while in elevation the throat forms, in effect, a ramp with an upward taper or lead toward the mouth and terminating in a vertical arcuate ledge 76 at the rear of the pocket region. A number of internal stiffening ribs 77 are integrally cast into the receiver to provide the necessary structural strength and to provide locating means for a railroad bogie locking key.

Figure 10:
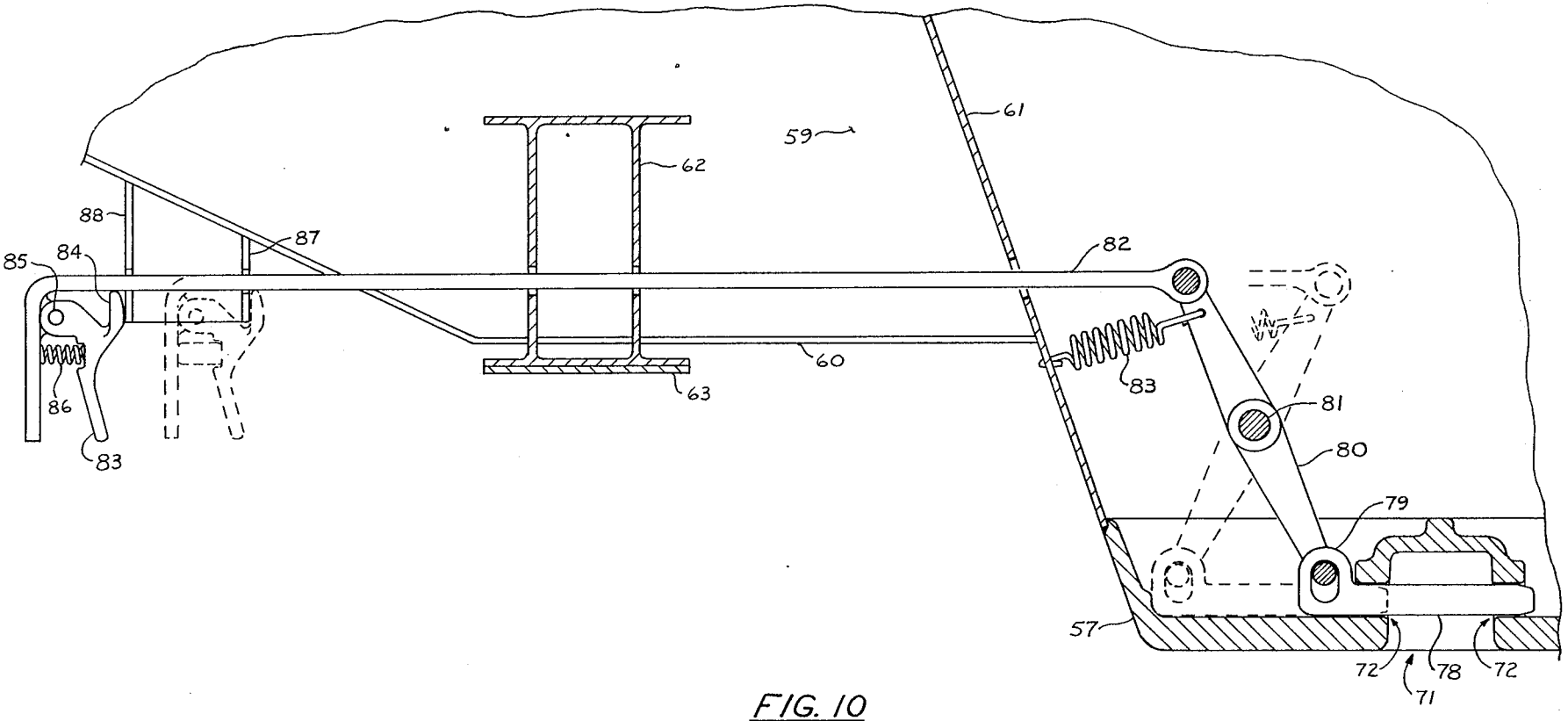
FIG. 10 is a partial transverse sectional view through the vehicle rear underframe showing the railroad bogie locking mechanism, taken on the line 10—10 of FIG. 6.

Referring to FIG. 10 where the releasable railroad bogie locking mechanism is shown in solid lines in its engaged position when in the railroad mode of operation, the mechanism serving to positively lock the railroad bogie to the vehicle body. The dashed lines in the figure show the locking mechanism in the disengaged position, used to release the railroad bogie from the vehicle body. A locking key 78, whose cross-section matches that of the holes 72 leading into the receiver pocket 71, is slidably located within the receiver casting 57 and is provided with an oblong eye 70 at its outward extreme. Engaging the eye 79 is a link member 80 whieh is pivotally mounted to the surrounding structure at its approximate center by a longitudinal shaft 81, the upper end of the link 80 pivotally connected to an operating pushrod 82 leading toward one side of the vehicle, the pushrod passing through clearance holes in the adjacent longitudinal structural members as shown. A spring 83 is connected between the upper end of the link member 80 and the surrounding structure, urging the link and hence the locking key 78 into the engaged position as shown. Affixed to the outer end of the operating pushrod 82 is a locking handle device composed of a handle 83 with an integral pawl 84 pivotally mounted to the operating pushrod at 85, the pawl being urged upward by compression spring 86, the operating pushrod being capable of axial movement through suitable guides 87 and 88 provided in the adjacent structure. As may be seen from the figure, the action of the pawl 84 serves to provide a positive lock against guide 88 thus securing the locking key 78 in its engaged position as shown, or the handle 83 may be grasped to disengage the pawl, the operating pushrod pushed inward, and the handle released. In this position, the pawl 84 will engage guide 87, thereby holding the locking key 78 in its disengaged position (shown dashed). Thus the railroad bogie locking mechanism may be operated safely by a person standing beside the vehicle.

Figure 11:
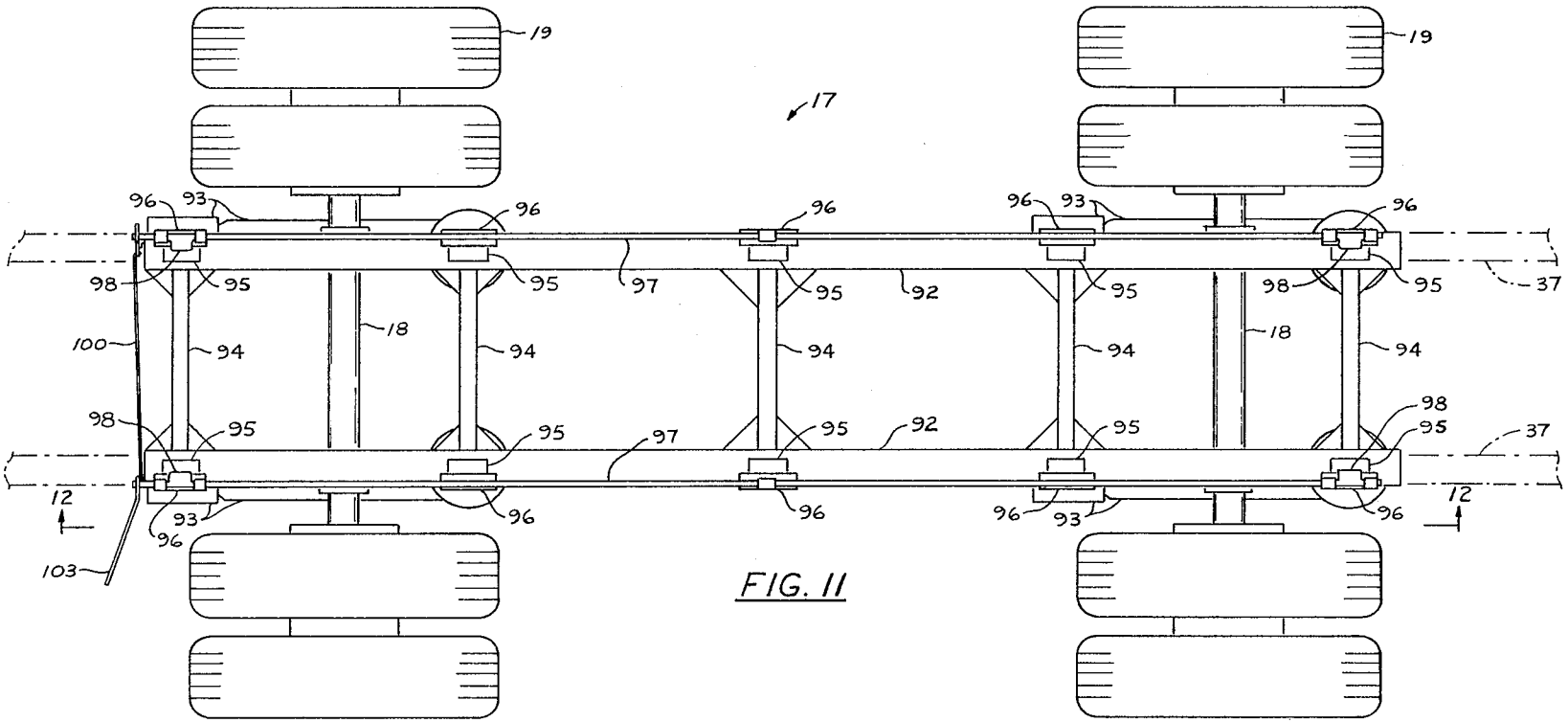
FIG. 11 is a plan view of the vehicle highway running gear taken on the line 11—11 of FIG. 2.
Figure 12:
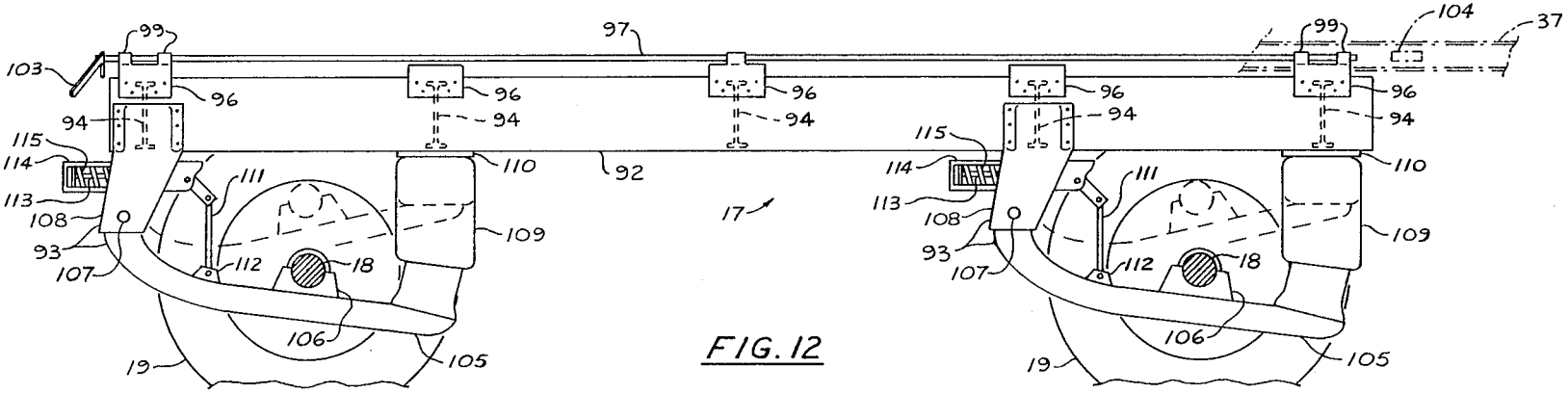
FIG. 12 is an elevational view of the vehicle highway running gear taken on the line 12—12 of FIG. 11.
Figure 13:
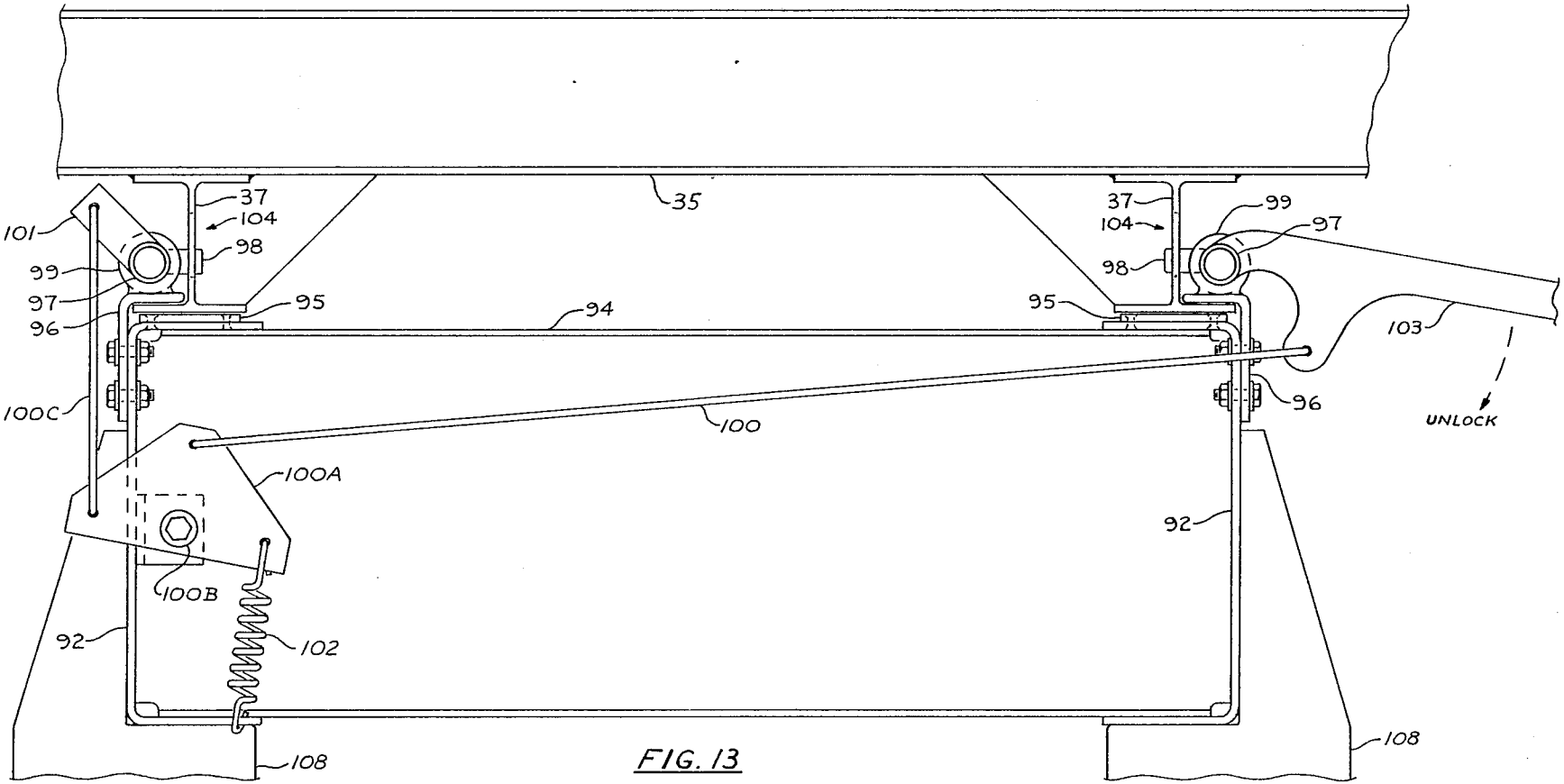
FIG. 13 is a partial end elevational view of the vehicle highway running gear taken on the line 13—13 of FIG. 1.

The highway running gear 17 may be seen in detail by referring to FIGS. 11, 12, and 13, the running gear basically being composed of a pair of longitudinal channel-section rails 92 with appropriate spacing transversly to accept highway suspension units 93 which will be described shortly. Joining the rails are transverse cross-members 94 thus forming a frame, phenolic or other similar slider pads 95 being fastened to the upper flanges of the main rails 92. Secured to the vehicle body cross-members as previously mentioned are running gear guide beams 37 (see also FIGS. 3 & 4) which could be I-section members, these running longitudinally with appropriate spacing transversely so that their lower flanges bear upon the slider pads located upon the upper flanges of the running gear main rails 92 as shown in FIG. 13. Spaced along the length of the running gear main rails 92 are several angle-section retainer clips 96, these secured to the main rails with bolts as shown in FIGS. 12 & 13. These clips serve to capture the running gear frame to the vehicle running gear guide beams 37, thus holding the running gear to the vehicle body while in the railroad mode of operation, the highway wheels being in their raised inoperative position at such times. As can be seen from FIGS. 1 & 2, the running gear guide beams 37 on the vehicle body are substantially longer than the running gear main rails 92 so that the fore-aft position of the highway running gear relative to the vehicle body can be varied.

The means to secure the highway running gear in either its forwardmost or rearmost position comprises longitudinal tubular shafts 97 rotatably mounted to the end retainer clips 96 of the running gear main rails 92, to which are welded protruding lugs 98. The shafts 97 are restrained in the axial direction by tubular sleeves 99 which capture the lugs 98 and which are welded to the end retainer clips 96. An operating lever 103 which protrudes toward one side of the vehicle is welded to the forward end of one tubular shaft 97. Referring to FIG. 13, the shafts 97 are mechanically slaved together by a linkage composed of a crossover push-rod 100, a bellcrank 100A pivotally connected to one of the running gear main rails as at 100B, a pushrod 100C, and a lever arm 101 which is welded to the forward end of the second tubular shaft 97. A spring 102 is operatively connected to the bellcrank 100A to urge the shafts into their locked positions as shown in FIG. 13. The running gear guide beams 37 are provided with sets of holes 104 (FIGS. 12 & 13) through their central webs corresponding to the locations of the lugs 98 secured to the rotatable shafts 97, one set of holes being located to correspond with the forwardmost location of the highway running gear, and a second set being located to correspond with the rearmost position of the high-way running gear (although intermediate positions could also be included). It can be seen in FIG. 13 that the lugs 98 protrude into the holes 104 of the running gear guide beams, this representing the locked position of the mechanism, the highway running gear thereby being secured against fore-aft movement. It can be seen from FIG. 13 that a downward movement of the operating lever 103 will cause the shafts 97 to rotate in opposite directions, thereby rotating the lugs 98 upward and out of engagement with the holes 104 provided in the running gear guide beams 37, thus freeing the highway running gear from fore-aft restraint. Repositioning of the highway running gear can then be accomplished as described earlier, after which the operating lever 103 is released, the spring 102 then urging the shafts 97 to rotate back to their locked positions with the lugs 98 engaging another set of holes in the running gear guide beams 37.

As stated earlier, the highway suspension or wheelset axle unit may be a single axle suspension as well as a tandem axle suspension as shown in the figures. It should further be understood that two independently mounted single axle highway suspensions could also be used. In this arrangement, the forward single axle suspension may be secured to the underframe of the vehicle body in a suitable longitudinally immovable position and the rear single axle suspension may be slidably mounted to the underframe of the vehicle body and longitudinally adjustable relative to the forward single axle suspension by the means previously described herein, to alter the vehicle weight distribution and thereby enhance the vehicle highway load capacity.

Coming now to the air spring means and lifting mechanism for the highway axle and wheels assemblies, reference is made to FIG. 12. It should be noted that the highway axle and wheel assemblies are suspended from the highway running gear rails 92 by air springs and lifting mechanisms embodied in commercially available suspension units as, for example, Model ART-555-B-3 Neway Air Ride units marketed by Neway Division, Lear Siegler, Inc., Muskegon, Mich. There are two such mechanisms per trailer axle 18 and each comprises a trailing arm 105 substantially on the center of which is mounted a bracket 106 which prevents the axle 18 from rotating and positions the axle on the trailing arm. The forward end of the trailing arm is pivoted for movement around a transverse axis as at 107 to a bracket 108 which is secured to one of the longitudinal running gear rails 92. At the other end of the trailing arm is mounted a conventional trailer air spring 109 which is secured at its upper end to the longitudinal running gear rail 92 as at 110.

In transferring the vehicle from the highway mode of the rail mode of operation, the air from the air spring 109 is vented to atmosphere, thereby allowing the axle and wheel assembly to be raised. The means to raise the highway wheel and axle assembly is comprised of a link 111 which is secured as at 112 to the trailing arm 105 forward of the axle 18, the link being connected by a further linkage to a rod 113. A suitable bracket 114 is secured to the suspension bracket 108. A compression spring 115 is wound about the rod 113 and is interposed between suitable stops. When the air spring 109 is pressurized and the highway wheels engage the ground, spring 115 is compressed. When the air spring 109 is depressurized with the vehicle body supported by the railroad bogie, the spring 115 expands, thereby raising the trailing arm and associated axle 18 and wheels 19 into the raised, stored position as shown dashed in FIG. 12. A suitable pneumatic control system will be described shortly. The brakes for the highway wheels are conventional and hence there is no need to show or describe them except in conjunction with the pneumatic control system, which will be explained shortly.

Figure 14:
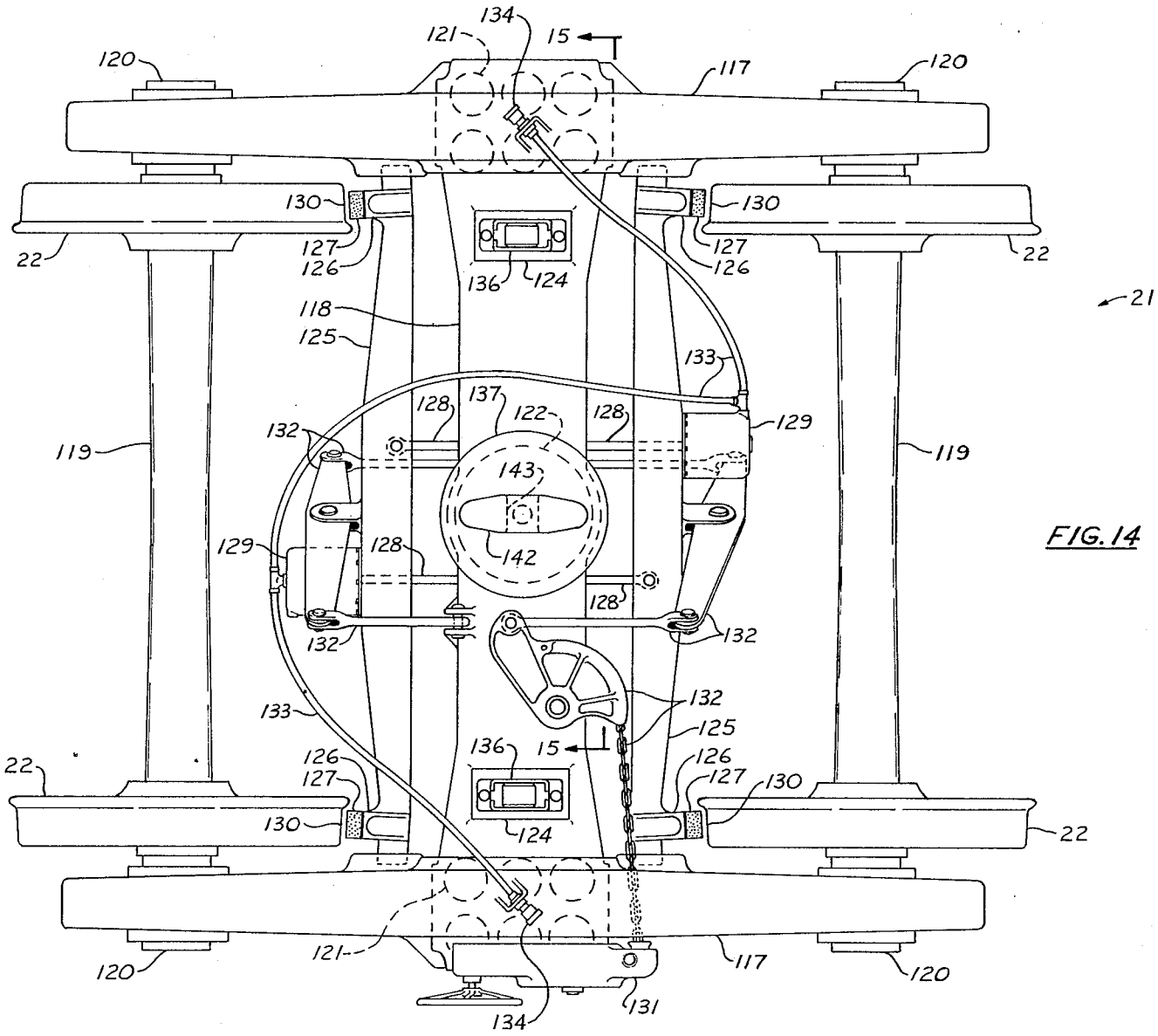
FIG. 14 is a plan view of the detachable railroad bogie.
Figure 15:
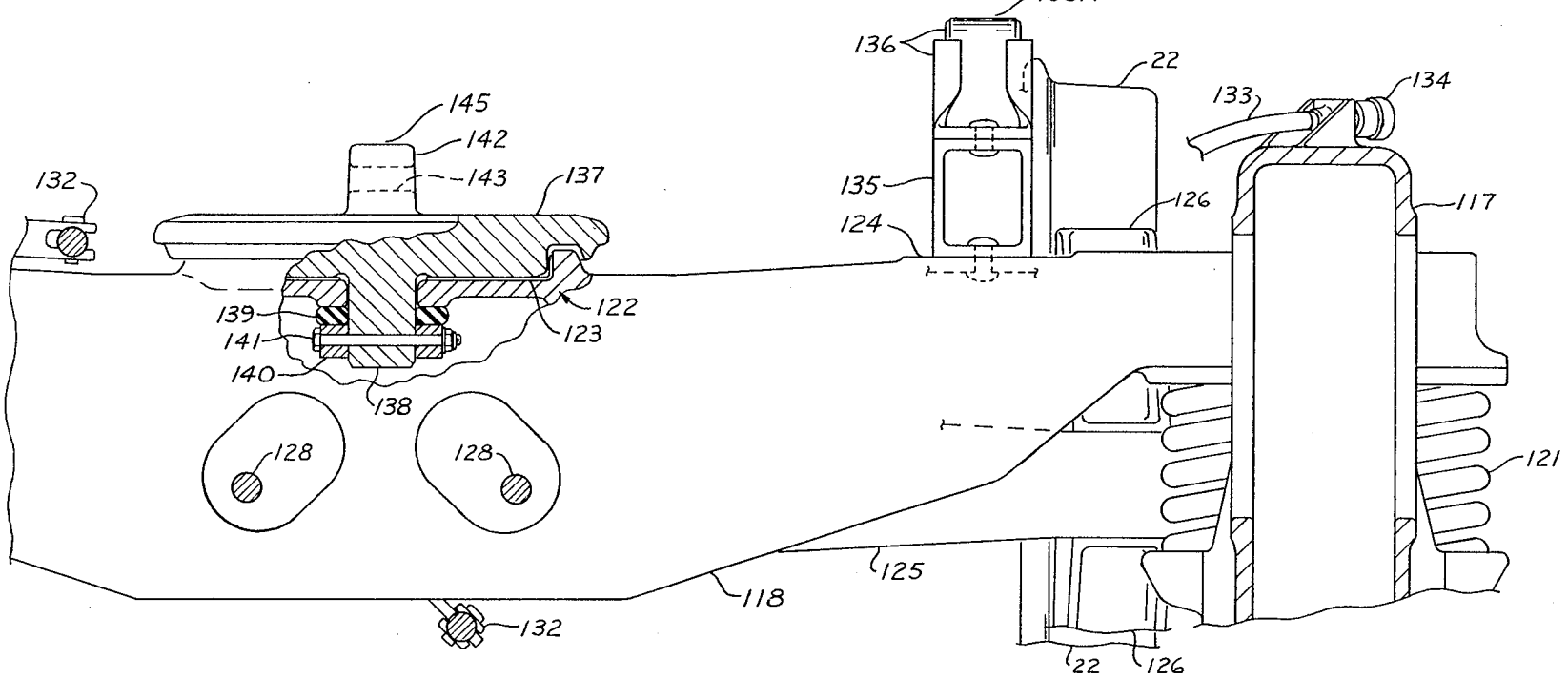
FIG. 15 is a partial transverse view of the detachable railroad bogie taken on the line 15—15 of FIG. 14.

The railroad bogie 21 is shown more particularly in FIGS. 14 and 15, whose general structural arrangement is that of the three-piece type comprising two longitudinal side frames 117 of substantially identical form located at proper spacing transversely by a transverse bolster 118 to accept conventional railroad wheelset assemblies which are each composed of an axle 119, two flanged railroad wheels 22 at appropriate rail spacing transversely, and suitable journal bearing assemblies 120. Interposed between each side frame 117 and the corresponding end of the bolster 118 are spring and damping means 121 providing the primary suspension, the bolster 118 thereby being cushioned from shocks encountered due to rail irregularities, etc. The bolster is provided with a center bowl 122 at its midpoint, usually lined with a replaceable wear liner 123 (FIG. 15), the center bowl serving as the primary load supporting point for the vehicle while in the railroad mode of operation, as will be seen. Located equidistant on either side of the center bowl and usually spaced about 4'-2" apart are side bearing mounting pads 124.

Slidably restrained into longitudinal jaws provided in the side frames 117 are conventional unit brake beams 125, to which are affixed brake heads 126 at appropriate spacing transversely, conventional railroad brake shoes 127 being removably affixed to the brake heads. A suitable pushrod arrangement 128 is provided to operatively interconnect the brake beams 125 with brake cylinders 129 so that upon pressurization of the brake cylinders by means which will be described, the brake beams are advanced toward the railroad wheels, thereby forcing the brake shoes 127 against the wheel tread areas 130, this action providing conventional friction braking. A manually-operable hand-brake device 131 is operatively interconnected with the brake beams by a suitable linkage 132, the handbrake being located on the side of the railroad bogie for easy operational accessibility. Hoses 133 are provided connecting the brake cylinders 129 to a pair of commercially available female disconnect fittings 134, one being located on each side of the railroad bogie for accessibility. The disconnect fittings 134 are each equipped with integral shutoff devices so that in the absence of a mating fitting, the integral shutoff devices close off their respective lines. As can be seen, a single brake cylinder hose with a mating fitting leading from the vehicle body to the railroad bogie may therefore be connected at either side of the railroad bogie without incurring leakage from the opposite, unused fitting.

Referring to FIG. 15, attached to the bolster side bearing mounting pads 124 by rivets or other suitable means are side bearing pedestals 135 which serve to raise the conventional bolster side bearings 136 approximately 5" above their regular position as used on standard freight railcars. The side bearings 136 are affixed to the pedestals 135 by rivets or other suitable means and are of standard railroad type, these serving to stabilize the vehicle body in roll while operating in the railroad mode as shall be seen. The side bearings are raised in this manner so that their corresponding bearing surfaces 136A are above the highest point on the railroad wheels, thus the supporting members 63 on the vehicle body (see FIG. 7) can pass above the railroad wheels without interference as the vehicle body is backed onto the railroad bogie for hook-up.

Into the bolster center bowl 122 is placed a center plate adapter casting 137, its lower part being substantially disc shaped with an integral downwardly extending center pin 138 protruding into the hollow bolster interior. A resilient donut shaped bushing 139 is placed on the center pin 138, followed by a retaining washer 140, both of these items being located in the hollow interior of the bolster. The retaining washer 140 is affixed to the center pin 138 by a suitable fastener 141 passing transversely through both members, the center plate adapter casting 137 thus being vertically secured into the bolster center bowl yet free to rotate about the axis of the center pin 138.

The upper portion of center plate adapter casting 137 includes an upwardly extending adapter lug 142 of generally oblong shape in plan view, an aperture 143 of suitable form passing transversely through the lug at its longitudinal center. Referring to FIGS. 14, 15, 9, and 10, it can be seen that the form of the adapter lug 142 substantially matches that of the pocket region 71 of the receiver casting 57 which is integral with the vehicle body, the adapter lug being slightly smaller in dimensions so as to easily fit into the pocket. It may also be seen that the aperture 143 provided in the adapter lug is positioned so as to align with the locking key 78 of the railroad bogie locking mechanism (as shown in FIG. 10) when the adapter lug is properly seated in the receiver pocket.

Referring to FIGS. 7, 8, 9, 10, 14, and 15, the process of transferring the vehicle from the highway mode of operation to the railroad mode of operation utilizes the elements heretofore described in the following manner. It is understood that the vehicle begins the process in the highway mode of operation; i.e. with the highway wheels in the ground-engaging operative position thereby supporting the rear end of the vehicle, and with a highway tractor connected to the vehicle kingpin and thereby supporting the vehicle nose, and with the railroad bogie in proper engagement with the railroad tracks, the transfer process taking place on a ground surface generally level with the top of the railroad tracks.

The vehicle is first backed toward the railroad bogie and is suitably maneuvered so that the mouth 75 of the vehicle receiver casting (FIG. 7) comes into general alignment with the adapter lug 142 of the railroad bogie center plate adapter casting 137 (FIGS. 14 and 15). At this time the railroad bogie locking mechanism is placed in its released position, thereby withdrawing the locking key 78 from the vehicle's receiver pocket 71 (FIG. 10).

Pneumatic means which will be described shortly are then operated to temporarily over-inflate the air springs of the highway suspension units, this action raising the rear of the vehicle slightly above its normal ride height. At this time, the lower corner 144 of the vertical ledge 76 of the vehicle's receiver pocket (FIG. 8) is at approximately the same height off the ground as is the upper surface 145 of the railroad bogie's adapter lug 142 (FIG. 15), the longitudinal beam members 63 (FIG. 7) oh the vehicle body being at a level well above the railroad bogie side bearings. The vehicle is then backed further by the highway tractor, the mouth 75 of the vehicle's receiver engaging the adapter lug 142 of the railroad bogie's center plate adapter casting 137. Due to the tapered shapes of the receiver's throat 74 and the railroad bogie's adapter lug 142, a guiding action takes place aligning the adapter lug with the receiver pocket, the adapter lug ultimately stopping as it engages the forward vertical surface 146 of the receiver pocket (FIG. 8).

Figure 16:
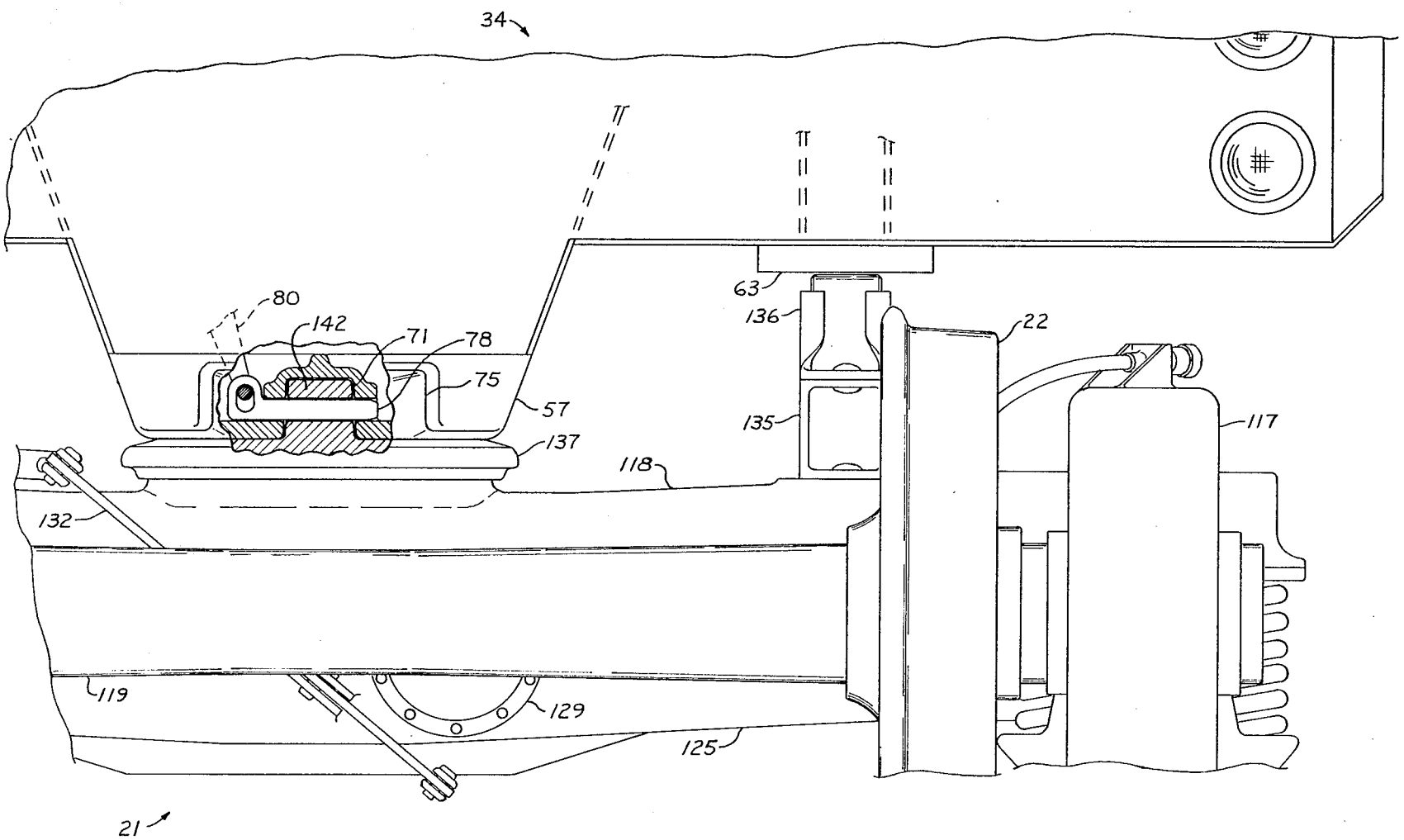
FIG. 16 is a partial rear elevational view of the vehicle body secured to the detachable railroad bogie.

Pneumatic means are then operated which exhaust the air springs of the highway suspension units As the highway wheels retract by mechanical means previously described, the vehicle body settles. The receiver therefore lowers onto the railroad bogie center plate adapter casting, the adapter lug 142 engaging the receiver pocket 71 as shown in FIG. 16. Simultaneously the longitudinal beam members 63 on the vehicle body lower onto the railroad bogie side bearings 136. As the highway wheels retract into their stored, inoperative positions, the vehicle body becomes supported by the railroad bogie bolster 118, the primary vertical support in the railroad mode being the bolster center plate adapter 137. Small clearances are provided between the railroad bogie side bearings 136 and their respective longitudinal beam members 63 on the vehicle body, thus the side bearings primarily provide roll stability.

At this time the railroad bogie locking mechanism (FIG. 10) is operated to advance the locking key 78 through the aperture 143 provided in the adapter lug of the railroad bogie center plate adapter casting. As can be seen in FIG. 16, this engaged position of the railroad bogie locking mechanism securely captures the railroad bogie center plate adapter casting, thus locking the railroad bogie to the vehicle body. As can be seen in the figures, rotational movement of the railroad bogie bolster relative to the vehicle body, as required through curves, occurs between the center plate adapter casting 137 and the bolster center bowl 122.

The vehicle, now supported at its rear by the railroad bogie, may be backed along the track by the highway tractor to be coupled to similar vehicles. When the coupling process is completed, the landing gear 16 may be extended into its load-supporting position, and the tractor disconnected from the kingpin and driven away. The process is repeated for each vehicle in turn until the desired train consist is formed, the landing gear of each vehicle being raised into its retracted position as another vehicle is added. In railroad configuration, the nose of each trailer vehicle is thus supported by the rear of the leading vehicle through the coupling system. It can be seen that the conversion from the railroad mode of operation to the highway mode is essentially the reverse of that just described.

Figure 17:
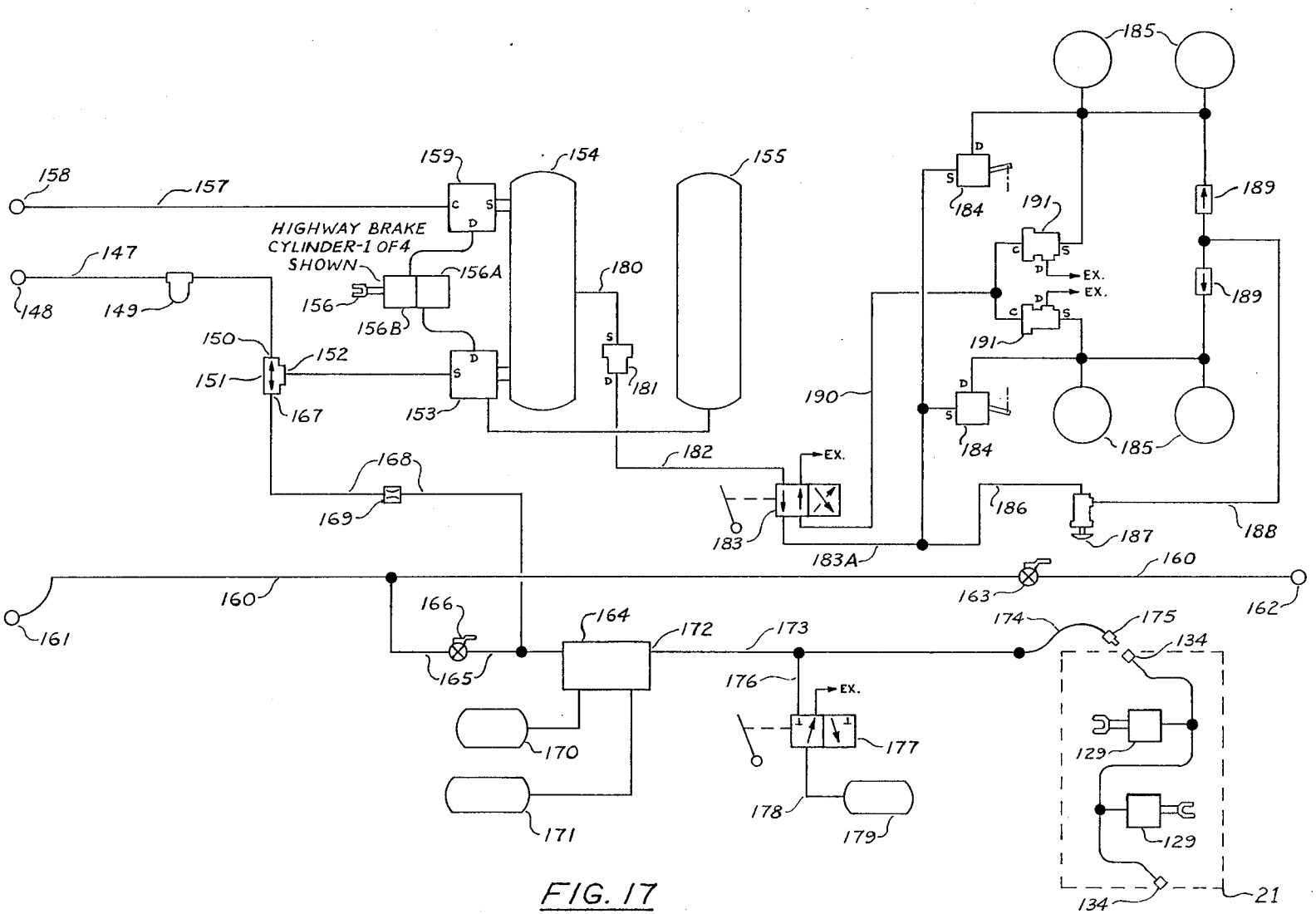
FIG. 17 is a diagrammatic view of the pneumatic control system.

Coming now to FIG. 17, pneumatic control means for the vehicle heretofore described are represented in schematic form. The pneumatic circuit shown provides the systems for operating the highway braking function, the railroad braking function, the highway air spring control function, and the auxiliary functions necessary for the operation of such a vehicle. It is understood that the elements described herein are physically located on the vehicle at convenient locations as required, with the exception of elements shown enclosed by a dashed line in FIG. 17, these elements being physically located on the railroad bogie 21.

A highway emergency line 147 which, in the highway mode of operation is kept continually pressurized to approximately 110 PSI whenever the vehicle is connected to a highway tractor, is provided with a separable connector or glandhand 148 to connect with the source of pressure. Compressed air from a highway tractor entering line 147 through connector 148 is piped through a filter 149 to one inlet port 150 of a shuttle valve 151. The outlet port 152 of the shuttle valve is piped to the supply port of conventional highway trailer valve 153, through which the highway service reservoir 154 and highway emergency reservoir 155 are charged. The trailer valve 153 also controls operation of the spring brake portions 156A of highway brake cylinders 156 for emergency and parking functions of the highway brakes should pressure be lost from its supply port, as is evident in trailer brake system prior art.

A highway service brake line 157 is connected to a highway tractor by a separable connector or gladhand 158 in the highway mode of operation, and is piped to the control port of highway brake relay valve 159. The service brake line 157 is normally open to atmosphere unless the service brakes are applied by the operator of the highway tractor, in which case the brake valve in the highway tractor (not illustrated) closes off the connection to atmosphere and pressurizes the service line 157, thereby operating highway brake relay valve 159 which admits stored air from highway service reservoir 154 to the service portions 156B of highway brake cylinders 156.

For railroad operation, a brake pipe 160 is connected to a locomotive by a separable coupling or gladhand 161, and at its opposite end may be connected to a trailing vehicle by a separable coupling or gladhand 162. In the absence of a trailing vehicle, the brake pipe may be closed off by a shutoff valve 163. The brake pipe 160 is connected to a railroad brake control valve 164 through line 165 and a normally-open cutout valve 166. The brake pipe is also connected to the second inlet port 167 of shuttle valve 151 by line 168 and a restrictor choke 169. As can be seen from the description thus far, air pressure supplied either from a highway tractor through the highway emergency line 147 or from a locomotive through the brake pipe 160 will charge both highway reservoirs 154 and 155 due to the action of shuttle valve 151. Air from the brake pipe 160 will also keep the highway parking brakes released during railroad operation by supplying air to the highway trailer valve 153. Since the highway service brake line 157 is open to atmosphere during railroad operation, the highway wheels are therefore free to rotate during rail operation, reducing the risk of damage should the highway wheels encounter obstructions on or adjacent the track. Restrictor choke 169 limits the amount of air that can be lost from the brake pipe 160, should a failure occur in the other elements of the system causing leakage.

The railroad brake control valve 164, typically of the ABD or ABDW type in common railroad usuage, operates with auxiliary reservoir 170 and emergency reservoir 171 to respond to pressure variations in the brake pipe 160 produced by the engineman's brake valve in the locomotive (not shown) to exhaust or produce a brake cylinder pressure at its brake cylinder port 172. When the brake pipe is pressurized, typically to about 80 PSI, the valve acts to exhaust any pressure which may be present at its brake cylinder port 172, pressure reductions in the brake pipe (produced by the engineman's brake valve) causing the valve to produce a proportional pressure at its brake cylinder port 172. Actual internal operation of the railroad brake control valve 164 may be determined by examining railroad brake valve prior art.

The brake cylinder port 172 of the railroad brake control valve 164 is connected by line 173 to a suitable hose 174 affixed to one side of the vehicle body adjacent its rear end. The hose is equipped with a suitable male quick-disconnect coupling 175 on its free end, the coupling 175 of the proper type to mate with female couplings 134 provided on the railroad bogie as previously discussed. Thus the brake cylinders 129 (on the railroad bogie) can conveniently be connected to the railroad brake control valve when the vehicle is operated in the railroad mode, or disconnected from same when the vehicle is transferred from the railroad mode to the highway mode of operation. The railroad bogie is provided with female fittings on both sides as previously mentioned so that the directional orientation of the railroad bogie on the track is of no importance at hook-up; the hose 174 from the vehicle body may be connected at either side without incurring leakage from the opposite, unused female fitting on the railroad bogie.

The brake cylinder port 172 of the railroad brake control valve 164 may also be connected by line 176 to the inlet port of a manually-operable, two-position, three-way valve 177, the outlet port of the valve then being connected by line 178 to an equalizing volume reservoir 179. For normal railroad operation with loaded vehicles, valve 177 is positioned to close off line 176 and open line 178 and thus the equalizing volume reservoir 179 to atmosphere, this position being shown in the figure. In this position, the full brake cylinder pressure developed by the railroad brake control valve 164 is available for the railroad bogie brake cylinders 129. Should the vehicle be operated in the railroad mode in an empty condition, valve 177 may be shifted to the left, thus being positioned to connect the equalizing volume reservoir 179 to the railroad brake control valve brake cylinder port 172 via lines J76 and 178. The additional volume added to the brake cylinder line 173 in this position serves to proportionally reduce the brake cylinder pressure produced by the railroad brake control valve, thus a lower pressure is available at the railroad bogie brake cylinders. This assists in eliminating undersirable rail wheel skidding under light load conditions due to excessive rail brake cylinder pressure.

The highway service reservoir 154 is connected by line 180 to the inlet port of pressure protection valve 181. The pressure protection valve 181 is used to protect the highway service reservoir from being depleted should a failure occur causing excessive air consumption at line 182. If such a failure should occur, pressure protection valve 181 closes at a preset pressure, i.e. 70 PSI, thus saving the remaining air in reservoir 154 for highway brake system use. The delivery port of pressure protection valve 181 is connected to the inlet or supply port of mode control valve 183 by line 182.

The mode control valve 183 or MCV is a four-way two-position manually-operated valve. Referring to FIG. 17, the MCV is drawn in its operative position for the highway mode of operation. In this position the MCV connects line 182 to line 183A, thus passing air from the highway reservoir 154 to the supply ports of conventional highway levelling valves 184, normally one levelling valve being provided for each side of the vehicle. The air then passes through the levelling valves 184 to the highway suspension air springs 185, inflating them until the vehicle body reaches its proper operating height. When proper operating height is reached, mechanical linkages between the highway axle and levelling valves cause the levelling valves to close, preventing further inflation of the air springs.

The supply port of a three-way, normally closed, momentary action pushbutton valve 187 is connected to the MCV by lines 183A and 186. The delivery port of the valve is connected to the juncture of check valves 189 by line 188, the check valves 189 each leading to the highway air springs 185 as can be seen in the figure. With the MCV in the highway position as shown, the momentary pushbutton valve 187 may be operated to allow highway reservoir air to flow through line 188 and check valves 189 directly into the highway air springs 185, thus bypassing the levelling valves 184. In this manner the vehicle's highway air springs may be overinflated to raise the body above its normal ride height for engagement with a railroad bogie as previously explained.

Retraction of the vehicle's highway wheels for railroad operation is accomplished by manually shifting the MCV 183 to its operative position for the railmode, this being toward the left in the figure. In this position, line 183A is opened to exhaust, thereby cutting off supply air to the levelling valves 184 and pushbutton valve 187. At the same time, highway reservoir air now passes through the MCV from line 182 to line 190, which leads to the control ports of normally-closed pilot operated valves 191. The supply ports of pilot operated valves 191 are connected directly to the highway air springs, their delivery ports being open to atmosphere as can be seen in the figure. When pressure is applied at the control ports of pilot valves 191 as just described, the valves open, thereby venting the highway air springs to atmosphere As explained earlier, the highway wheels will then retract into their raised inoperative positions by mechanical means.

The vehicle may be returned to the highway mode of operation by simply shifting the MCV back to its highway position as shown in the figure. The MCV then exhausts line 190 to atmosphere, allowing pilot valves 191 to close, the highway air springs being inflated as previously described. The letters S, C, D, and EX where they appear on the figure denote supply, control, delivery, and exhaust ports of the valves respectively.

Thus, it can be seen that an economically and operationally viable vehicle is provided which is readily and safely operable in either the highway or railroad mode of travel, and which provides a simple and practical means of converting from one mode of operation to the other and vice-versa without expensive and specialized external handling equipment; and skilled artisans may make variations without departing from the spirit of the invention.

What is claimed is:

1. A dual-mode rail-highway semi-trailer comprising:

a semi-trailer body, a highway wheel-set axle unit, air spring means supporting said body on said highway wheel-set axle unit, means to selectively raise said highway wheel-set axle unit to an inoperative position and to lower the same into a ground-engaging operative position for over-the-road highway travel;

the semi-trailer body including a rear underframe structure which includes a receiver member with a downwardly opening pocket forming a component of means to releasably lock a railroad bogie to said body, said underframe including transversely spaced supporting members adapted to bear upon a railroad bogie to support said body in roll;

a track-engaging railroad bogie including side frame members supporting dual wheel-set axle units and a central transverse bolster joining said frame members, said means to releasably lock said railroad bogie to said body further including a bowl located centrally in said bolster, an adapter having a disc plate including a downwardly extending pin rotatably retained in said bolster bowl, said disc plate being disposed on top of said bolster, a lug extending upwardly from said disc plate and extendable into said receiver member pocket and means to releasably lock said upward lug in said receiver member to thereby releasably lock said railroad bogie to said semitrailer body to the rear of said highway wheel-set axle unit; and a female member opening horizontally at the rear end of said body for coupling to a male member at the front end of a similar body to couple the similar bodies end-to-end to form a train operable on tracks with said highway wheel-set axle units in their raised inoperative positions, and when said bodies are uncoupled, said highway wheel-set units are lowered to ground-engaging positions and said railroad bogie is detached from said body, said bodies being adaptable for connection to tractors for over-the-road highway travel.

high-axle units are lowered to ground-engaging positions and said railroad bogie is detached from said body, said bodies being adaptable for connection to tractors for over-the-road highway travel.

2. The combination of claim 1 including an aperture through said upwardly extending lug, a key slidable through said aperture and a linkage pivotally connected to said body and operatively connected to said key to selectively move said key into said aperture for the locked position, and out of said aperture for the unlocked position and stops cooperative with said linkage to selectively retain said key in its extended and retracted positions.

3. The combination of claim 1 including means to adjustably shift said highway wheel-set axle unit longitudinally of said body to alter weight distribution and thereby enhance highway load capacity.

4. The combination of claim 1 wherein said highway wheel-set axle unit includes a pair of spaced independently mounted forward and rear axles, and means to adjustably shift said rear axle longitudinally relative to said forward axle to alter weight distribution and thereby enhance highway load capacity.

5. The combination of claim 1 including a source of compressed air and valved conduits carried by said body and operatively connected to said air spring means forming a pneumatic means to selectively inflate and deflate said air spring means.

6. The combination of claim 5 including means to releasably retain said highway wheel-set axle unit in its raised inoperative position in the rail mode of travel.

7. The combination of claim 1 in which the receiver member has a lug guiding downwardly opening and tapered throat leading to the pocket.

8. A dual-mode rail-highway semi-trailer comprising:

a semi-trailer body having a highway wheel-set axle unit and means to selectively raise said highway wheel-set axle unit to an inoperative position and to lower the same into a ground-engaging operative position for over-the-road highway travel;

the semi-trailer body including a rear underframe structure which includes a receiver member with a downwardly opening pocket forming a component of means to releasably lock a railroad bogie to said body;

a track-engaging railroad bogie including side frame members supporting dual wheel-set axle units and a central transverse bolster joining said side frame members, said means to releasably lock said railroad bogie to said body further including a bowl located centrally in said bolster, an adapter having a disc plate including a downwardly extending pin rotatably retained in said bolster bowl, said disc plate being disposed on top of said bolster, a lug extending upwardly from said disc plate and extendable into said receiver member pocket and means to releasably lock said upward lug in said receiver member to thereby releasably lock said railroad bogie to said semitrailer body to the rear of said highway wheel-set axle unit; and a female member opening horizontally at the rear end of said body for coupling to a male member at the front end of a similar body to couple the similar bodies end-to-end to form a train operable on tracks with said highway wheel-set axle units in their raised inoperative positions, and when said bodies are uncoupled, said highway wheel-set axle units are lowered to ground-engaging positions and said railroad bogie is detached from said body, said bodies being adaptable for connection to tractors for over-the-road highway travel.

9. The combination of claim 8 in which the receiver member has a lug guiding downwardly opening and tapered throat leading to the pocket.

10. A dual-mode rail-highway semi-trailer comprising:

a semi-trailer body having a highway wheel-set axle unit and means to selectively raise said highway wheel-set axle unit to an inoperative position and to lower the same into a ground-engaging operative position for over-the-road highway travel;

the semi-trailer body including a rear underframe structure which includes a receiver member with a downwardly opening pocket forming a component of means to releasably lock a railroad bogie to said body;

a track-engaging railroad bogie having a transverse bolster including a bowl located centrally in said bolster;

an adapter having a disc plate including a downwardly extending pin rotatably retained in said bolster bowl, said disc plate being disposed on top of said bolster, and a lug extending upwardly from said disc plate and extendable into said receiver member pocket; and means to releasably lock said upward lug in said receiver member to thereby releasably lock said railroad bogie to said semi-trailer body.

11. The combination of claim 10 in which the lug can easily fit in the pocket but cannot rotate relative to the pocket.

12. The combination of claim 11 in which the lug is oblong shaped in plan view and the receiver pocket has a similar internal oblong shape thereby permitting the semitrailer to be coupled from either end of the bogie.

13. The combination of claim 10 in which the receiver member has a lug guiding downwardly opening and tapered throat leading to the pocket.

14. In a dual-mode rail-highway semi-trailer having a body, a highway wheel-set axle unit, air spring means supporting said body on said highway wheel-set axle unit, means to selectively raise said highway wheel-set axle unit to an inoperative position and to lower the same into a ground-engaging operative position for over-the-road highway travel, a track-engaging railroad bogie and an adapter mounted on said bogie for rotation about a vertical axis; a bidirectional locating and guiding means comprising a receiver means opening at the rear end of said body, said receiver means including a pocket having a tapered throat opening through the rear end of the body, a member carried by said adapter having longitudinally opposed portions each adapted to be guided and received in said receiving means at the rear of said body whether oriented at one longitudinally opposed portion or the other of said member, said longitudinally opposed portions being tapered noses each adapted to be guided into said receiver pocket through said throat, and means to releasably lock said member in said receiver means.

15. For use with a dual-mode rail-highway semi-trailer, a railroad bogie comprising side frame members, rail wheel-set axle units carried by said frame members, a central transverse bolster, an adapter mounted on said bolster for rotation about a vertical axis, a bidirectional locating and guiding means carried by said adapter including a member having longitudinally opposed portions each adapted to be guided and received in an end-opening pocket in a semi-trailer body to be releasably locked therein, and each of said longitudinally opposed portions having a tapered nose for guidance into the pocket in said body through its open end.

16. A dual-mode rail-highway semi-trailer comprising a body, a highway wheel-set axle unit, air spring means supporting said body on said highway wheel-set axle unit, means to selectively raise said highway wheel-set axle unit to an inoperative position and to lower the same into a ground-engaging operative position for over-the-road highway travel, a track-engaging bogie, an adapter mounted on said bogie for rotation about the central vertical axis of said bogie, and means to releasably lock the rear of said body to said adapter, said locking means including a receiver member at the rear of said body having a downwardly opening pocket leading to a rear opening throat including an upwardly tapered ramp surface, a lug extending upwardly from said adapter and complementary to said pocket and means to releasably lock said lug in said pocket, said lug including a longitudinally extending tapered portion which engages said ramp surface to facilitate guidance of said lug into said pocket, whereby to convert the trailer from the highway mode to the rail mode, the trailer is backed up towards said bogie while the latter is on the tracks, the air spring means are over-inflated until the rear end of the body is raised to be in substantial alignment with the top of said lug, the backing up is continued so that said lug engages said ramp surface and is guided into alignment with said pocket and upon subsequent deflation of the air spring means, said highway wheel-set axle unit is elevated above the track level and the rear of the body is simultaneously lowered so that the lug enters said pocket and is there locked with the bogie supporting the rear of said body.

17. The combination of claim 16 wherein said lug includes longitudinally extending tapered portions at opposite ends of said lug so that said lug can be guided into said pocket from either side of said bogie.

18. A road and rail transport system comprising:

a plurality of semi-trailers (10), each semi-trailer (10) comprising a body member (11), road wheels (19) fixed to said body member's (11) trailing end (13) for supporting said semi-trailer (10) during over-the-road travel, connecting means (15) fixed to said body member's (11) leading end (12) connecting said semi-trailer (10) to a tractor unit, a body bolster (26,34,36,51) fixed to each end of said body member (11);

body member coupling means (12,45) connected to each body bolster (26,34) that cooperates to permit a leading end (12) of a semi-trailer (10,11) to be releasably coupled directly to a trailing end of a second semi-trailer (10,11) for allowing movement of one semi-trailer relative to the other about a first substantially vertical axis (12) and for allowing part of the load of each said semi-trailer to be transmitted along said vertical axis;

a plurality of bogies (21), each bogie (21) comprising two axles (119), bogie wheels (22) mounted on said axles (119), a frame (117) supporting said axles (119), a central bogie bolster (118) arranged between said axles (119), a pocket (122) formed in said bogie bolster (118), a mounting member (137) mounted in said pocket (122) for limited bearing movement relative to said pocket (122), and a substantially planar covering surface (137) fixed to said mounting member (137) to prevent ingress of dirt and moisture in said pocket from above; and quick release bogie/semi-trailer coupling means having a first part (142) mounted on the covering surface (137) of said bogie's mounting member (137) and a second part (57,71) mounted on a semi-trailer's trailing end body bolster, said bogie/semi-trailer coupling means permitting said semi-trailer to pivot relative to said bogie about a second substantially vertical axis (138) passing through the center of said pocket (122) and mounting member (137), said second vertical axis (138) substantially coinciding with said first vertical axis (12);

said bogie/semi-trailer coupling means permitting trains of bogies and semi-trailers to be readily assemblied where said bogies are always used together with said semi-trailers in said system's rail mode but where said semi-trailers are demountable from said bogies and used independent therefrom in said system's road mode; and each semi-trailer comprising brake pipe means (160–169) and each bogie comprising brake means (125–129;133–134), said bogies' brake means being serially interconnectable with each other through said semi-trailer' brake pipe means when said bogies and semi-trailers are assembled to form a train, and said brake means being operable through control means on a locomotive arranged to drive the train.

19. A road and trail transport system comprising:

a plurality of semi-trailer (10), each semi-trailer (10) comprising a body member (11), road wheels (19) fixed to said body member's (11) trailing end for supporting said semi-trailer (10) during over-the-road travel, connecting means (15) fixed to said body member's (11) leading end for connecting said semi-trailer (10) to a tractor unit, a body bolster (26,34) fixed to each end of said body member (11);

body member coupling means (12,45) connected to each body bolster (26,34) that cooperates to permit a leading end of a first semi-trailer (10,11) to be releasably coupled directly to a trailing end of a second semi-trailer (10,11) for allowing movement of one semi-trailer relative to the other about a first substantially vertical axis and for allowing part of the load of each said semi-trailer to be transmitted along said vertical axis;

a plurality of bogies (21), each bogie (21) comprising two axles (119), bogie wheels (22) mounted on said axles (119), a frame (117) supporting said axles (119), a central bogie bolster (118) arranged between said axles (119), a pocket (122) formed in said bogie bolster (118), a mounting member (137) mounted in said pocket (122) for limited bearing movement relative to said pocket (122), and a substantially planar covering surface (137) fixed to said mounting member (137) to prevent ingress of dirt and moisture in said pocket from above;

quick release bogie/semi-trailer coupling means having a first part (142) mounted on the covering surface (137) of said bogie's mounting member (137) and a second part (57,71) mounted on a semi-trailer's trailing end body bolster, said bogie/semi-trailer coupling means permitting said semi-trailer to pivot relative to said bogie about a second substantially vertical axis (138) passing through the center of said pocket (122) and mounting member (137), said second vertical axis (138) substantially coinciding with said first vertical axis (12);

said bogie/semi-trailer coupling means permitting trains of bogies and semi-trailers to be readily assemblied where said bogies are always used together with said semi-trailers in said system's rail mode but where said semi-trailers are demountable from said bogies and used independent therefrom in said system's road mode; and said bogie/semi-trailer coupling means comprising a member (142) upstanding from said bogie's mounting member and formed with structure defining an aperture (143) and a locking member (78) adapted to be received in said aperture.

20. The system of claim 19, said upstanding member comprising an apertured block (142).

21. A road and rail transport system comprising:

a plurality of semi-trailer (10), each semi-trailer (10) comprising a body member (11), road wheels (19) fixed to said body member's (11) trailing end for supporting said semi-trailer (10) during over-the-road travel, connecting means (15) fixed to said body member's (11) leading end for connecting said semi-trailer (10) to a tractor unit, a body bolster (26,34) fixed to each end of said body member (11);

body member coupling means (12,45) connected to each body bolster (26,34) that cooperates to permit a leading end (12) of a first semi-trailer (10,11) to be releasably coupled directly to a trailing end of a second semi-trailer (10,11) for allowing movement of one semi-trailer relative to the other about a first substantially vertical axis (12) and for allowing part of the load of each said semi-trailer to be transmitted along said vertical axis;

a plurality of bogies (21), each bogie (21) comprising two axles (119), bogie wheels (22) mounted on said axles (119), a frame (117) supporting said axles (119), a central bogie bolster (118) arranged between said axles (119), a pocket (122) formed in said bogie bolster (118), a mounting member (137) mounted in said pocket (122) for limited bearing movement relative to said pocket (122), and a substantially planar covering surface (137) fixed to said mounting member (137) to prevent ingress of dirt and moisture in said pocket from above; and quick release bogie/semi-trailer coupling means having a first part (142) mounted on the covering surface (137) of said bogie's mounting member (137) and a second part (57,71) mounted on a semi-trailer's trailing end body bolster, said bogie/semi-trailer coupling means permitting said semi-trailer to pivot relative to said bogie about a second substantially vertical axis (138) passing through the center of said pocket (122) and mounting member (137), said second vertical axis (138) substantially coinciding with said first vertical axis (12);

said bogie/semi-trailer coupling means permitting trains of bogies and semi-trailers to be readily assemblied where said bogies are always used together with said semi-trailers in said system's rail mode but where said semi-trailers are demountable from said bogies and used independent therefrom in said system's road mode;

each semi-trailer comprising brake pipe means (160-169), and each bogie comprising brake means (125-129; 133-134), said bogies' brake means being serially interconnectable with each other through said semi-trailers' brake pipe means when said bogies and semi-trailers are assemblied to form a train, and said brake means being operable through control means on a locomotive arranged to drive the train; and way wheel-set axle unit to an inoperative position and to lower the same into a ground-engaging operative position for over-the-road highway travel;

the semi-trailer body including a rear underframe structure which includes a receiver member with a downwardly opening pocket forming a component of means to releasably lock a railroad bogie to said body, said underframe including transversely spaced supporting members adapted to bear upon a railroad bogie to support said body in roll;

a track-engaging railroad bogie including side frame members supporting dual wheel-set axle units and a central transverse bolster joining said side frame members, said means to releasably lock said railroad bogie to said body further including a bowl located centrally in said bolster, an adapter having a disc plate including a downwardly extending pin rotatably retained in said bolster bowl, said disc plate being disposed on top of said bolster, a lug extending upwardly from said disc plate and extendable into said receiver member pocket and means to releasably lock said upward lug in said receiver member to thereby releasably lock said railroad bogie to said semi-trailer body to the rear of said highway wheel-set axle unit; and a female member opening horizontally at the rear end of said body for coupling to a male member at the front end of a similar body to couple the similar bodies end-to-end to form a train operable on tracks with said highway wheel-set axle units in their raised inoperative positions, and when said bodies are uncoupled, said highway wheel-set said bogie/semi-trailer coupling means comprising a member (142) upstanding from said bogie's mounting member (137) and formed with structure defining an aperture (143); and a locking member (78) adapted to be received in said aperture.

22. The system of claim 21, said upstanding member comprising an apertured block (142).

* * * * *

UNITED STATES PATENT AND TRADEMARK OFFICE

CERTIFICATE OF CORRECTION

PATENT NO. : 4,955,292

DATED : Sept. 11, 1990

INVENTOR(S) : Christopher A. Cripe

It is certified that error appears in the above-identified patent and that said Letters Patent is hereby corrected as shown below:

Column 4, Line 60, delete "illustrates" and substitute -- illustrating --.

Column 4, Line 67, delete "pay load" and substitute -- payload --.

Column 5, Line 19, delete "re-arranged" and substitute -- re-engaged --.

Column 5, Line 37, after "12", insert -- centers --.

Column 11, Line 50, delete "oh", and substitute -- on --.

Column 11, Line 63, after "units", insert -- . --.

Column 14, Line 23, delete "J76", and substitute -- 176 --.

Column 15, Line 19, after "atmosphere", insert -- . --.

column 15, Line 58, after "said", insert -- side --.

Column 16, Line 8, after "wheel-set", insert -- axle --.

UNITED STATES PATENT AND TRADEMARK OFFICE

CERTIFICATE OF CORRECTION

PATENT NO. : 4,955,292

DATED : Sept. 11, 1990

INVENTOR(S) : Christopher A. Cripe

It is certified that error appears in the above-identified patent and that said Letters Patent is hereby corrected as shown below:

Column 16, Lines 14-17, delete "high-axle units are lowered to ground-engaging positions and said railroad bogie is detached from said body, said bodies being adaptable for connection to tractors for over-the-road highway travel."

Column 18, Line 66, after "of a", insert -- first --.

Column 19, Line 38, delete "semi-trailer', and substitute -- semi-trailers' --.

Column 19, Line 43, delete "trail", and substitute -- rail --.

Column 20, Line 40, delete ":" and substitute -- ; --.

UNITED STATES PATENT AND TRADEMARK OFFICE

CERTIFICATE OF CORRECTION

PATENT NO. : 4,955,292

DATED : Sept. 11, 1990

INVENTOR(S) : Christopher A. Cripe

It is certified that error appears in the above-identified patent and that said Letters Patent is hereby corrected as shown below:

Column 21, Line 20 through Column 22, Line 22, delete "way wheel-set axle unit to an inoperative position and to lower the same into a ground-engaging operative position for over-the-road highway travel;

the semi-trailer body including a rear underframe structure which includes a receiver member with a downwardly opening pocket forming a component of means to releasably lock a railroad bogie to said body, said underframe including transversely spaced supporting members adapted to bear upon a railroad bogie to support said body in roll;

UNITED STATES PATENT AND TRADEMARK OFFICE

CERTIFICATE OF CORRECTION

PATENT NO. : 4,955,292

DATED : Sept. 11, 1990

INVENTOR(S) : Christopher A. Cripe

It is certified that error appears in the above-identified patent and that said Letters Patent is hereby corrected as shown below:

"a track-engaging railroad bogie including side frame members supporting dual wheel-set axle units and a central transverse bolster joining said side frame members, said means to releasably lock said railroad bogie to said body further including a bowl located centrally in said bolster, an adapter having a disc plate including a downwardly extending pin rotatably retained in said bolster bowl, said disc plate being disposed on top of said bolster, a lug extending upwardly from said disc place and extendable into said receiver member pocket and means to releasably lock said upward lug in said receiver member to thereby releasably lock said railroad bogie to said semi-trailer body to the rear of said highway wheel-set axle unit; and a female member opening horizontally at the rear end of said body for coupling to a male member at the front end of a similar body to couple the similar bodies end-to-end to form a train operable on tracks with said highway wheel-set axle units in their raised inoperative positions, and when said bodies are uncoupled, said highway wheel-set".

Signed and Sealed this

Twenty-fifth Day of February, 1992

*Attest:*

HARRY F. MANBECK, JR.

*Attesting Officer*

*Commissioner of Patents and Trademarks*